US009033467B2

(12) United States Patent
Kondo et al.

(10) Patent No.: US 9,033,467 B2
(45) Date of Patent: May 19, 2015

(54) LIQUID JETTING APPARATUS, ACTUATOR DEVICE, AND METHOD FOR PRODUCING LIQUID JETTING APPARATUS

(71) Applicants: Hirofumi Kondo, Aichi-ken (JP); Shuhei Hiwada, Aichi-ken (JP); Kazuteru Kojima, Aichi-ken (JP)

(72) Inventors: Hirofumi Kondo, Aichi-ken (JP); Shuhei Hiwada, Aichi-ken (JP); Kazuteru Kojima, Aichi-ken (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 13/968,597

(22) Filed: Aug. 16, 2013

(65) Prior Publication Data

US 2014/0063125 A1 Mar. 6, 2014

(30) Foreign Application Priority Data

Aug. 31, 2012 (JP) ..... 2012-191960

(51) Int. Cl.
*B41J 2/14* (2006.01)
*B41J 2/16* (2006.01)

(52) U.S. Cl.
CPC *B41J 2/14* (2013.01); *B41J 2/1621* (2013.01); *Y10T 29/49401* (2015.01); *B41J 2/14233* (2013.01); *B41J 2002/14491* (2013.01); *B41J 2202/08* (2013.01)

(58) Field of Classification Search
CPC ..... B41J 2002/14491; B41J 2/14072; B41J 2/26; B41J 2/265; B41J 2202/18; B41J 2/14129; B41J 2/16; B41J 2/1607; B41J 2/1623
USPC ..... 347/50
See application file for complete search history.

(56) References Cited

U.S. PATENT DOCUMENTS

| | | | | |
|---|---|---|---|---|
| 6,070,965 | A * | 6/2000 | Fujimoto | 347/50 |
| 2009/0066758 | A1* | 3/2009 | Von Essen et al. | 347/50 |
| 2010/0245474 | A1* | 9/2010 | Okubo | 347/44 |
| 2011/0240762 | A1* | 10/2011 | Suzuki et al. | 239/289 |
| 2013/0182044 | A1* | 7/2013 | Kinokuni | 347/50 |

FOREIGN PATENT DOCUMENTS

| | | |
|---|---|---|
| JP | 2008/054401 | 3/2008 |
| JP | 8267745 | 3/2008 |
| JP | 2009/269314 | 11/2009 |
| JP | 2010/073319 | 4/2011 |

* cited by examiner

*Primary Examiner* — Matthew Luu
*Assistant Examiner* — Patrick King
(74) *Attorney, Agent, or Firm* — Frommer Lawrence & Haug LLP

(57) ABSTRACT

A liquid jetting apparatus includes: a channel unit formed with a plurality of nozzles and a plurality of liquid channels communicating with the nozzles; an actuator including a plurality of drive sections, which are provided to correspond to the nozzles, include a plurality of connecting terminals, and are configured to apply jetting energy to a liquid in the liquid channels; and a flexible wiring member including a plurality of connecting portions joined to the plurality of connecting terminals of the actuator and a plurality of wires connected to the connecting portions. The wiring member includes a protrusion formed by bending a portion, different from a portion formed with the connecting portions, at which at least a part of the wires are formed, to project toward a side opposite to a connecting surface for connecting with the actuator.

18 Claims, 15 Drawing Sheets

LIQUID JETTING APPARATUS, ACTUATOR DEVICE, AND METHOD FOR PRODUCING LIQUID JETTING APPARATUS

CROSS REFERENCE TO RELATED APPLICATION

The present application claims priority from Japanese Patent Application No. 2012-191960, filed on Aug. 31, 2012, the disclosure of which is incorporated herein by reference in its entirety.

BACKGROUND OF THE INVENTION

1. Field of the Invention

The present invention relates to a liquid jetting apparatus which jets a liquid from nozzles, an actuator device which is used for the liquid jetting apparatus and the like, and a method for producing the liquid jetting apparatus which jets the liquid from the nozzles.

2. Description of the Related Art

As a liquid jetting apparatus which jets a liquid from nozzles, an ink-jet printer which performs printing by discharging an ink from an ink-jet head is disclosed in Japanese Patent Application laid-open No. 2008-54401. In the ink-jet printer disclosed in Japanese Patent Application laid-open No. 2008-54401, the ink-jet head is configured by stacking each other a channel unit in which ink channels including the nozzles, pressure chambers connected to the nozzles, etc., are formed, and a piezoelectric actuator for applying pressure to the ink in the pressure chambers. The piezoelectric actuator includes a vibration plate which covers the pressure chambers, a first piezoelectric layer arranged on the upper surface of the vibration plate, and a second piezoelectric layer arranged on the upper surface of the first piezoelectric layer. Further, a first common electrode is formed on upper surface of the vibration plate, individual electrodes are formed between the first and second piezoelectric layers, and a second common electrode is formed on the upper surface of the second piezoelectric layer so that the first common electrode, the individual electrodes, and the second common electrode face to the pressure chambers, respectively. The first common electrode, the individual electrodes, and the second common electrode are pulled out or drawn up to areas, of the vibration plate, not overlapping with the first and second piezoelectric layers. These pulled out portions (connecting terminals) of these electrodes are connected to a flexible flat cable (wiring member having flexibility) arranged above the piezoelectric actuator.

Here, a plurality of wires, each of which is connected to one of the electrodes of the piezoelectric actuator, are formed in the wiring member disclosed in Japanese Patent Application laid-open. No. 2008-54401. Further, upon request of high densely arranged nozzles, apparatus downsizing, and the like, many electrodes are often arranged densely in the piezoelectric actuator of the ink-jet head. In this case, also for the wiring member, many wires are arranged to correspond to the electrodes of the piezoelectric actuator. However, in a case that many wires are arranged in the wiring member, it is not possible to ensure an enough spacing distance between the wires. Thus, problems such as short-circuit between the wires are more likely to occur.

SUMMARY OF THE INVENTION

An object of the present teaching is to provide a liquid jetting apparatus, an actuator device and a method for producing the liquid jetting apparatus which are cable of ensuring an enough spacing distance between wires in a wiring member even when connecting terminals are arranged densely in an actuator.

According to a first aspect of the present teaching, there is provided a liquid jetting apparatus, including: a channel unit formed with a plurality of nozzles and a plurality of liquid channels communicating with the nozzles; an actuator including a plurality of drive sections, which are provided to correspond to the nozzles respectively, include a plurality of connecting terminals, and are configured to apply jetting energy to a liquid in the liquid channels; and a flexible wiring member including a plurality of connecting portions joined to the plurality of connecting terminals of the actuator respectively and a plurality of wires connected to the connecting portions respectively, wherein the wiring member includes a protrusion formed by bending a portion of the wiring member, which is different from a portion formed with the connecting portions and at which at least a part of the wires are formed, to project toward a side opposite to a connecting surface, of the wiring member, for connecting with the actuator.

According to a second aspect of the present teaching, there is provided an actuator device, including: an actuator including a plurality of drive sections provided with a plurality of connecting terminals, respectively; and a wiring member including a plurality of connecting portions joined to the connecting terminals of the actuator respectively and a plurality of wires connected to the connecting portions respectively, wherein the wiring member includes a protrusion formed by bending a portion of the wiring member, which is different from a portion formed with the connecting portions and at which at least a part of the wires are formed, to project toward a side opposite to a connecting surface, of the wiring member, for connecting with the actuator.

According to these teachings, since the protrusion is provided in the wiring member, an area (dimension), of the wiring member, in which the wires can be arranged, increases. Further, by arranging the wires in the protrusion, even when many wires are formed in the wiring member, it is possible to ensure a sufficient spacing distance between the wires.

According to a third aspect of the present teaching, there is provided a method for producing a liquid jetting apparatus, including: providing a channel unit formed with a plurality of nozzles and a plurality of liquid channels communicating with the nozzles; providing an actuator including a plurality of drive sections, which are provided to correspond to the nozzles respectively, include a plurality of connecting terminals, and are configured to apply jetting energy to a liquid in the liquid channels; providing a flexible wiring member including a plurality of connecting portions to be joined to the plurality of connecting terminals of the actuator and a plurality of wires connected to the connecting portions; and joining the connecting portions to the connecting terminals respectively in a state that a portion of the wiring member, which is different from a portion formed with the connecting portions and at which at least a part of the wires are formed, is bent to project toward a side opposite to a connecting surface, of the wiring member, for connecting with the actuator.

According to the present teaching, even when the wiring member has a size to such an extent that the spacing distance between the wires is sufficiently secured, by joining the wiring member in a state of being bent to the actuator, it is possible to join the connecting terminals and the connecting portions upon positioning. Further, in a case that heating is performed at the time of the joining, difference of amount of extension/contraction between the actuator and the wiring member, due to difference in linear expansion coefficient, can be absorbed by deformation of the portion, of the wiring member, in a state of being bent.

DESCRIPTION OF THE PREFERRED EMBODIMENTS

Hereinbelow, explanations will be made with respect to preferred embodiments of the present teaching.

Figure 1:
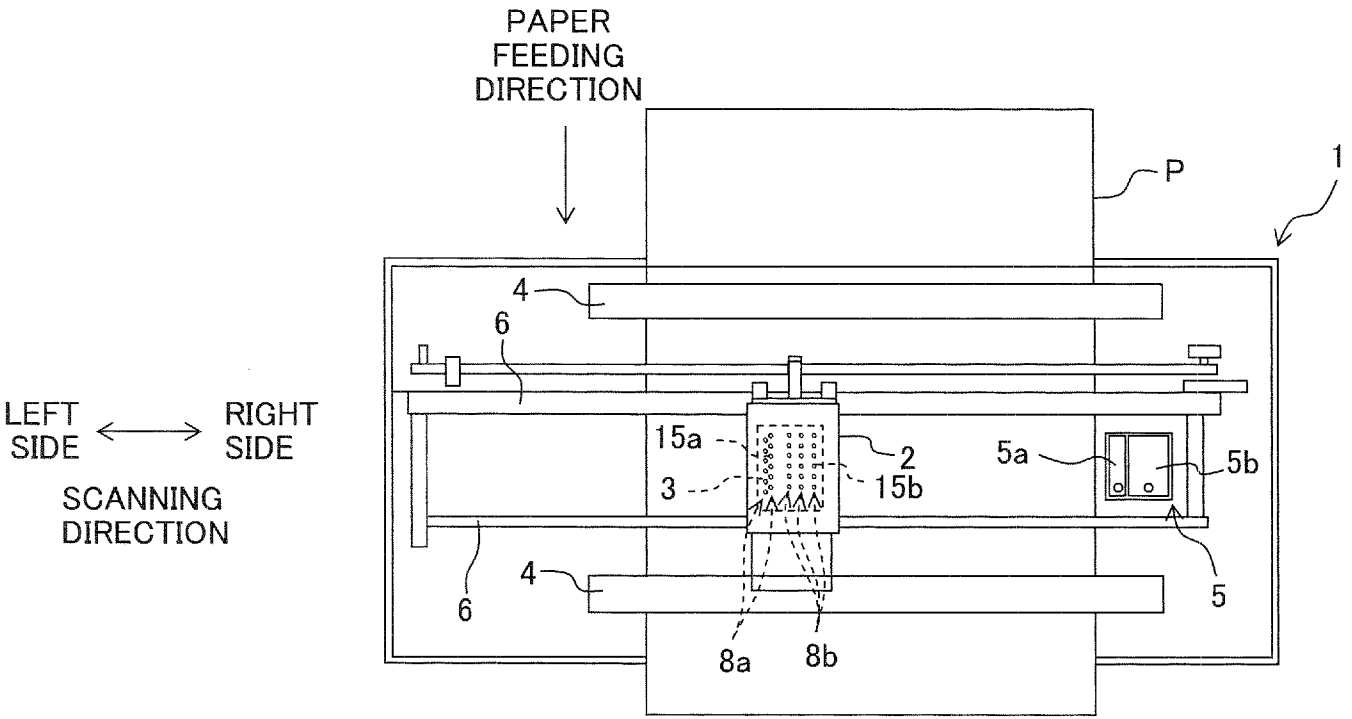
FIG. 1 is a schematic configuration diagram of a printer according to an embodiment of the present teaching.

As shown in FIG. 1, a printer 1 according to this embodiment includes a carriage 2, an ink-jet head 3, paper transport rollers 4, a purge cap 5, and the like. The carriage 2 reciprocatively moves in a scanning direction (second direction) along two guide rails 6. Hereinbelow, the right side and the left side in the scanning direction shown in FIG. 1 are defined simply as a right side and a left side, respectively. Then, an explanation will be made by using the definition.

The ink-jet head 3 is carried on the carriage 2, and an ink is discharged from a plurality of nozzles 15*a*, 15*b* formed on the lower surface of the ink-jet head 3. The paper transport rollers 4 are disposed on opposite sides of the carriage 2 in a paper feeding direction (first direction) perpendicular to the scanning direction and transport a recording paper sheet P in the paper feeding direction.

The printer 1 performs printing on the recording paper sheet P as follows. That is, the ink is discharged from the ink-jet head 3 which reciprocatively moves in the scanning direction together with the carriage 2 while the recording paper sheet P is transported in the paper feeding direction by the paper transport rollers 4. The recording paper sheet P having printing carried out thereon is discharged by the paper transport rollers 4 in the paper feeding direction.

The purge cap 5 is arranged at a position located below the ink-jet head 3 and is configured to face the ink-jet head 3 when the carriage 2 is moved to the most rightward position in the scanning direction. The purge cap 5 includes cap portions 5*a* and 5*b*. The cap portion 5*a* is configured to face the nozzles 15*a* in a state that the ink-jet head 3 is opposed to the purge cap 5. The cap portion 5*b* is configured to face the nozzles 15*b* in the state that the ink-jet head 3 is opposed to the purge cap 5. The purge cap 5 is able to move up and down by an unillustrated lifting mechanism. In a case that the purge cap 5 is moved upward in the state that the ink-jet head 3 is opposed to the purge cap 5, the nozzles 15*a* are covered with the cap portion 5*a* and the nozzles 15*b* are covered with the cap portion 5*b*.

Each of the cap portions 5*a* and 5*b* is connected to an unillustrated suction pump. By driving the suction pump in a state that the nozzles 15*a* and 15*b* are covered with the cap portions 5*a* and 5*b*, it is possible to perform a so-called suction purge in which the ink in the ink-jet head 3 is sucked from the nozzles 15*a* and 15*b*.

Next, the ink-jet head 3 will be explained. The ink-jet head 3 includes a channel unit 21 in which the nozzles 15*a* and 15*b*, ink channels including a plurality of pressure chambers 10*a* and 10*b* which will be described later, and the like are formed, and a piezoelectric actuator 22 for applying pressure to the ink in the pressure chambers 10*a* and 10*b*.

The channel unit 21 is formed to have four plates including a cavity plate 31, a base plate 32, a manifold plate 33, and a nozzle plate 34, the plates being stacked in this order from the top. Except the nozzle plate 34, the three plates 31 to 33 are formed of a metallic material such as stainless steels. The nozzle plate 34 is formed of a synthetic-resin material such as polyimide.

The plurality of pressure chambers 10*a* and 10*b* are formed in the cavity plate 31. Each of the pressure chambers 10*a* has an approximate ellipse shape, in a planner view, which is elongated in the scanning direction. The pressure chambers 10*a* are arranged in the paper feeding direction to form a pressure chamber array 9*a*. Further, two pressure chamber arrays 9*a* are arranged closely to each other in the scanning direction in the cavity plate 31. The pressure chambers 10*a* constructing one of the pressure chamber arrays 9*a* and the pressure chambers 10*a* constructing the other of the pressure chamber arrays 9*a* are positioned off each other in the paper feeding direction by half of the spacing distance between the pressure chambers 10*a* in each of the pressure chamber arrays 9*a*.

Each of the pressure chambers 10*b* has an approximate ellipse shape, in a planner view, which is the same shape as each of the pressure chambers 10*a*. The pressure chambers 10*b* are arranged on the right side of the pressure chambers 10*a* in the paper feeding direction to form a pressure chamber array 9*b*. Further, in the cavity plate 31, three pressure chamber arrays 9*b* are arranged adjacently to one another in the scanning direction, and the pressure chambers 10*b* constructing the three pressure chamber arrays 9*b* are arranged at the same positions in the paper feeding direction as the pressure chambers 10*a* constructing the pressure chamber array 9*a* disposed on the right side.

Substantially circular through holes 12*a*, 13*a* corresponding to each of the pressure chambers 10*a* and substantially circular through holes 12*b*, 13*b* corresponding to each of the pressure chambers 10*b* are formed in the base plate 32. The through holes 12*a* are opposed to left end portions of the pressure chambers 10*a* constructing the pressure chamber array 9*a* disposed on the left side and right end portions of the pressure chambers 10*a* constructing the pressure chamber array 9*a* disposed on the right side. The through holes 13*a* are opposed to right end portions of the pressure chambers 10*a* constructing the pressure chamber array 9*a* disposed on the left side and left end portions of the pressure chambers 10*a* constructing the pressure chamber array 9*a* disposed on the right side. The through holes 12*b* are opposed to right end portions of the pressure chambers 10*b*. The through holes 13*b* are opposed to left end portions of the pressure chambers 10*b*.

The manifold plate 33 is formed with two manifold channels 11*a* provided corresponding to the two pressure chamber arrays 9*a* respectively, and three manifold channels 11*b* provided corresponding to the three pressure chamber arrays 9*b* respectively.

Each of the two manifold channels 11*a* extends over the pressure chambers 10*a* constructing one of the pressure chamber arrays 9*a* in the paper feeding direction. The two manifold channels 11*a* are opposed to the approximate left half portions of the pressure chambers 10*a* constructing the pressure chamber array 9*a* disposed on the left side and to the approximate right half portions of the pressure chambers 10*a* constructing the pressure chamber array 9*a* disposed on the right side, respectively. The two manifold channels 11*a* are connected with each other at the end portion on the downstream side in the paper feeding direction, and a black ink is supplied from an ink supply port 7*a* provided at a connecting portion of the two manifold channels 11*a*.

Each of the three manifold channels 11*b* extends over the pressure chambers 10*b* constructing one of the pressure chamber arrays 9*b* in the paper feeding direction. The three manifold channels 11*b* are opposed to the approximate right half portions of the pressure chambers 10*b*. Color inks are supplied from ink supply ports 7*b* provided at the end portion on the downstream side in the paper feeding direction to the three manifold channels 11*b*, respectively. In particular, to the three manifold channels 11*b*, inks of yellow, cyan, and magenta are supplied in the order of the manifold channels 11*b* from the left side of FIG. 2. Further, the manifold plate 33 is formed with substantially circular through holes 14*a* and 14*b* at portions facing the through holes 13*a* and 13*b*, respectively.

The nozzle plate 34 is formed with the plurality of nozzles 15*a*, 15*b* at portions facing the plurality of through holes 14*a*, 14*b*, respectively. The nozzles 15*a* (first nozzles) are aligned in the paper feeding direction (first direction) to form each nozzle array 8*a*, and two nozzle arrays 8*a* are arranged, in the scanning direction (second direction), closely to each other corresponding to the two pressure chamber arrays 9*a* in the nozzle plate 34. Further, the nozzles 15*a* forming one of the nozzle arrays 8*a* and the nozzles 15*a* forming the other of the nozzle arrays 8*a* are positioned off each other in the paper feeding direction by half of the spacing distance between the nozzles 15*a* in each of the nozzle arrays 8*a*.

The nozzles 15*b* (second nozzles) are aligned in the paper feeding direction to form each nozzle array 8*b*. In the nozzle plate 34, three nozzle arrays 8*b* are arranged, in the scanning direction, adjacently to one another corresponding to the three pressure chamber arrays 9*b*. Inks (second inks) of yellow, cyan, and magenta are jetted from the plurality of nozzles 15*b* in the order of the nozzle arrays 8*b* from the left side of FIG. 2.

As described above, in this embodiment, the number of the nozzles 15*a* from which the black ink is jetted is approximately double the number of nozzles 15*b* from which the yellow ink is jetted, the number of nozzles 15*b* from which the cyan ink is jetted, and the number of nozzles 15*b* from which the magenta ink is jetted. By arranging the nozzles 15*a* forming the two nozzle arrays 8*a* in a state of being shifted in the paper feeding direction, the nozzles 15*a* are arranged in the paper feeding direction with density approximately twice that of the nozzles 15*b*.

Figure 2:
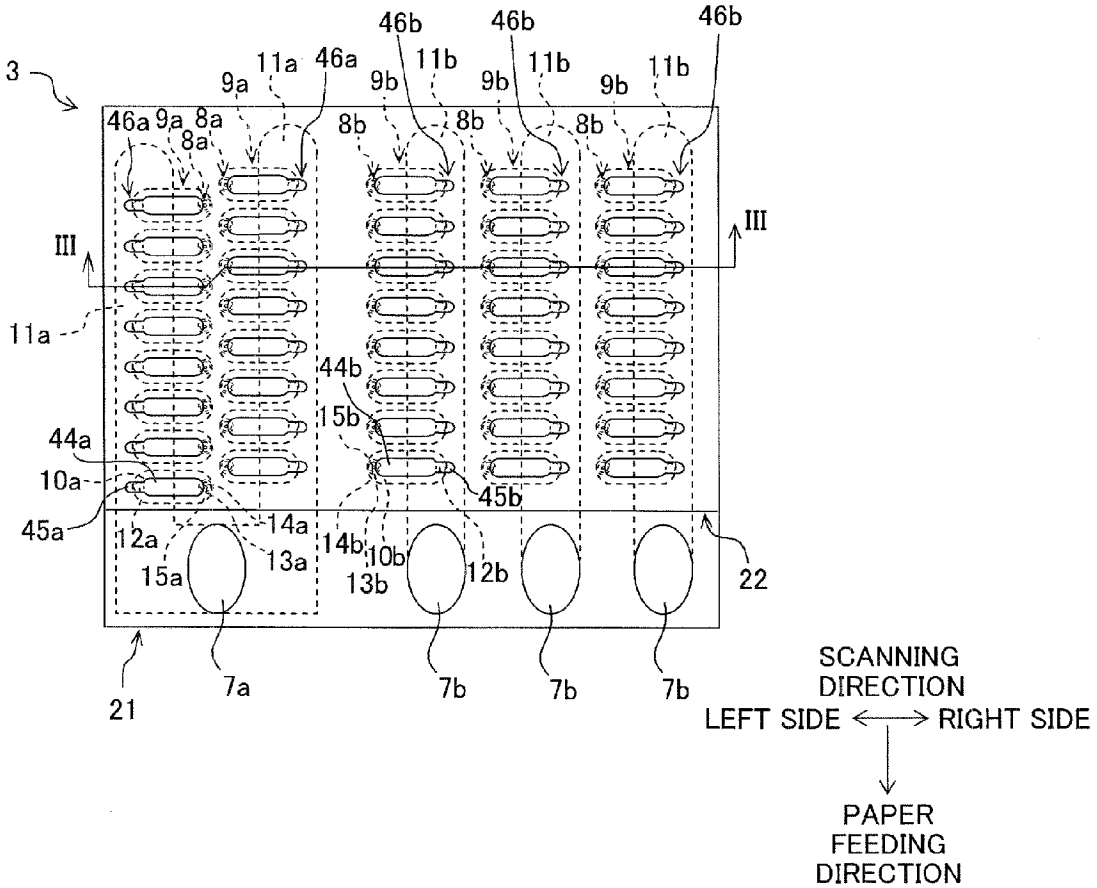
FIG. 2 is a plan view of an ink-jet head of FIG. 1.

In the ink-jet head 3, the black ink (first ink) is discharged from the nozzles 15*a* and the inks (second inks) of yellow, cyan, and magenta are discharged from the nozzles 15*b* in the order of the nozzle arrays 8*b* from the left side of FIG. 2.

In the channel unit 21, the manifold channels 11*a* are communicated with the pressure chambers 10*a* via the through holes 12*a*, and the pressure chambers 10*a* are communicated with the nozzles 15*a* via the through holes 13*a* and 14*a*. Accordingly, a plurality of individual ink channels, each of which ranges from the exit of the manifold channel 11*a* via the pressure chamber 10*a* to arrive at the nozzle 15*a*, are formed in the channel unit 21. Similarly, a plurality of individual ink channels, each of which ranges from the exit of the manifold channel 11*b* via the pressure chamber 10*b* to arrive at the nozzle 15*b*, are formed in the channel unit 21.

The piezoelectric actuator 22 includes a vibration plate 41, a piezoelectric layer 42, a common electrode 43, and a plurality of individual electrodes 44*a* and 44*b*. The vibration plate 41 is made of a piezoelectric material composed mainly of lead zirconate titanate which is a mixed crystal of lead titanate and lead zirconate. The vibration plate 41 is arranged on the upper surface of the cavity plate 31 to cover the pressure chambers 10*a* and 10*b*. The vibration plate 41 may be formed of a material other than the piezoelectric material, unlike the piezoelectric layer 42 which will be explained next. The piezoelectric layer 42 is made of the same piezoelectric material as the vibration plate 41 and extends continuously, on the upper surface of the vibration plate 41, while ranging over the pressure chambers 10*a* and 10*b*.

The common electrode 43 is formed on a substantially entire surface between the vibration plate 41 and the piezoelectric layer 42, and is constantly maintained at the ground potential by a driver IC 52 which will be described later. Each of the individual electrodes 44*a* and 44*b* has an approximate ellipse shape in a plane view which is one size smaller than each of the pressure chambers 10*a* and 10*b*, and is arranged at a portion facing the approximately central portion of one of the pressure chambers 10*a* and 10*b*, on the upper surface of the piezoelectric layer 42 (connecting surface for connecting with a COF 49 as will be described later on). Any one of the ground potential and a predetermined driving electric potential (for example, about 20V) is selectively applied to each of the individual electrodes 44*a* and 44*b* by the driver IC 52 which will be described later.

The individual electrodes 44*a* and 44*b* extend in the scanning direction to positions on a side opposite to the nozzles 15*a* and 15*b* and not facing the pressure chambers 10*a* and 10*b*, respectively. Tip portions of the individual electrodes 44*a* and 44*b* are connecting terminals 45*a* and 45*b*, respectively. Accordingly, two connecting terminal arrays 46*a*, each of which is formed by aligning the connecting terminals 45*a* in the paper feeding direction, are arranged in the scanning direction; and three connecting terminal arrays 46*b*, each of which is formed by aligning the connecting terminals 45*b* in the paper feeding direction, are arranged in the scanning direction. In FIG. 2, a distance, in the scanning direction, between the connecting terminal array 46*a* disposed on the right side and the connecting terminal array 46*b* disposed on the leftmost side is about 1 to 2 mm.

Corresponding to the arrangements of the common electrode 43 and the individual electrodes 44*a* and 44*b* as described above, portions, of the piezoelectric layer 42, interposed between the common electrode 43 and the individual electrodes 44*a* and 44*b* are polarized in the thickness direction of the piezoelectric layer 42.

In this embodiment, combinations of the vibration plate 41; portions, of the piezoelectric layer 42, facing the pressure chambers 10*a*; portions, of the common electrode 43, facing the pressure chambers 10*a*; and the individual electrodes 44*a* facing the pressure chambers 10*a* correspond to a plurality of drive sections according to the present teachings. Combinations of the vibration plate 41; portions, of the piezoelectric layer 42, facing the pressure chambers 10*b*; portions, of the common electrode 43, facing the pressure chambers 10*b*; and the individual electrodes 44*b* facing the pressure chambers 10*b* also correspond to the drive sections according to the present teaching.

An explanation will be made about a method for discharging the ink from the nozzles 15*a* and 15*b* by driving the piezoelectric actuator 22. In the ink-jet head 3, the individual electrodes 44*a* and 44*b* are maintained at the ground potential in advance. In a case that the ink is discharged from one nozzle 15*a* and one nozzle 15*b*, the electric potential of the individual electrodes 44*a* and 44*b* corresponding to the one nozzle 15*a* and the one nozzle 15*b* respectively is switched to the predetermined driving electric potential. Then, due to the potential difference between the common electrode 43 and the individual electrodes 44*a* and 44*b*, an electric field is generated at a portion, of the piezoelectric layer 42, sandwiched between the common electrode 43 and the individual electrodes 44*a* and 44*b* in a thickness direction parallel to the polarization direction of the piezoelectric layer 42. With this, the above portion of the piezoelectric layer 42 contracts in a planar direction perpendicular to the polarization direction, and portions, of the piezoelectric layer 42 and the vibration plate 41, facing the corresponding pressure chambers 10*a* and 10*b*, are deformed to be convex toward the pressure chambers 10*a* and 10*b*. As a result, volumes of the pressure chambers 10*a* and 10*b* are decreased to increase pressure of the ink in the pressure chambers 10*a* and 10*b* (jetting energy is applied), and thereby discharging the ink from the nozzles 15*a* and 15*b* communicating with the pressure chambers 10*a* and 10*b*.

Figure 3:
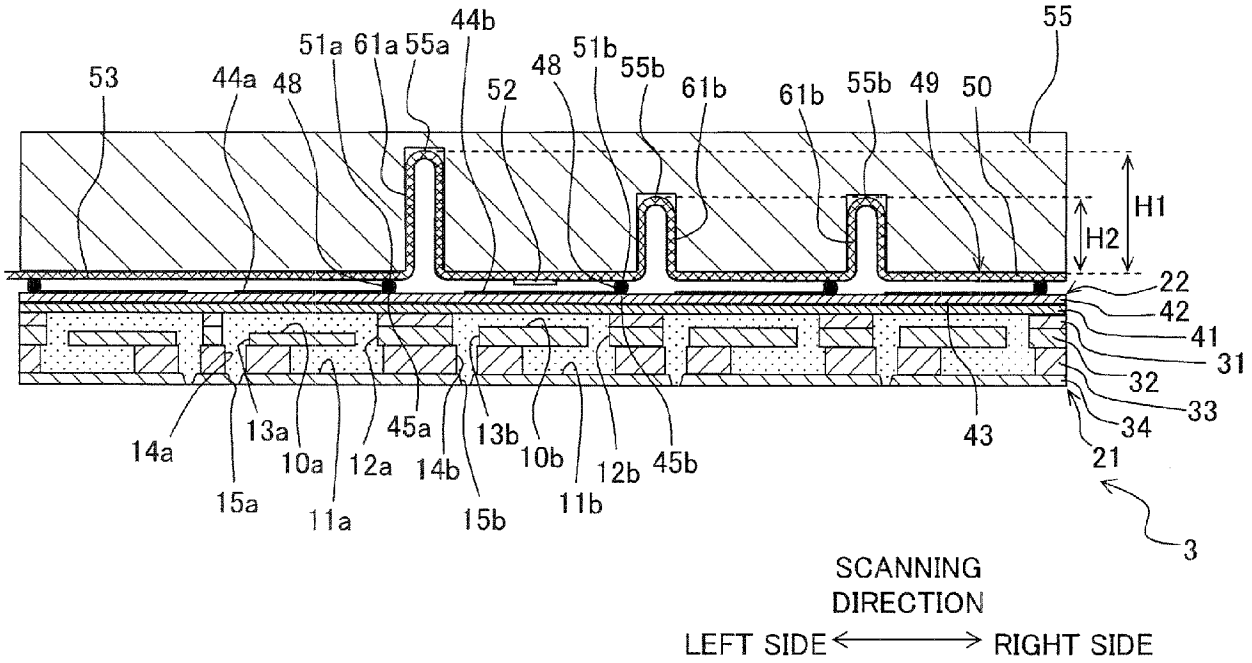
FIG. 3 is a cross-sectional view taken along a line III-III in FIG. 2.
Figure 4:
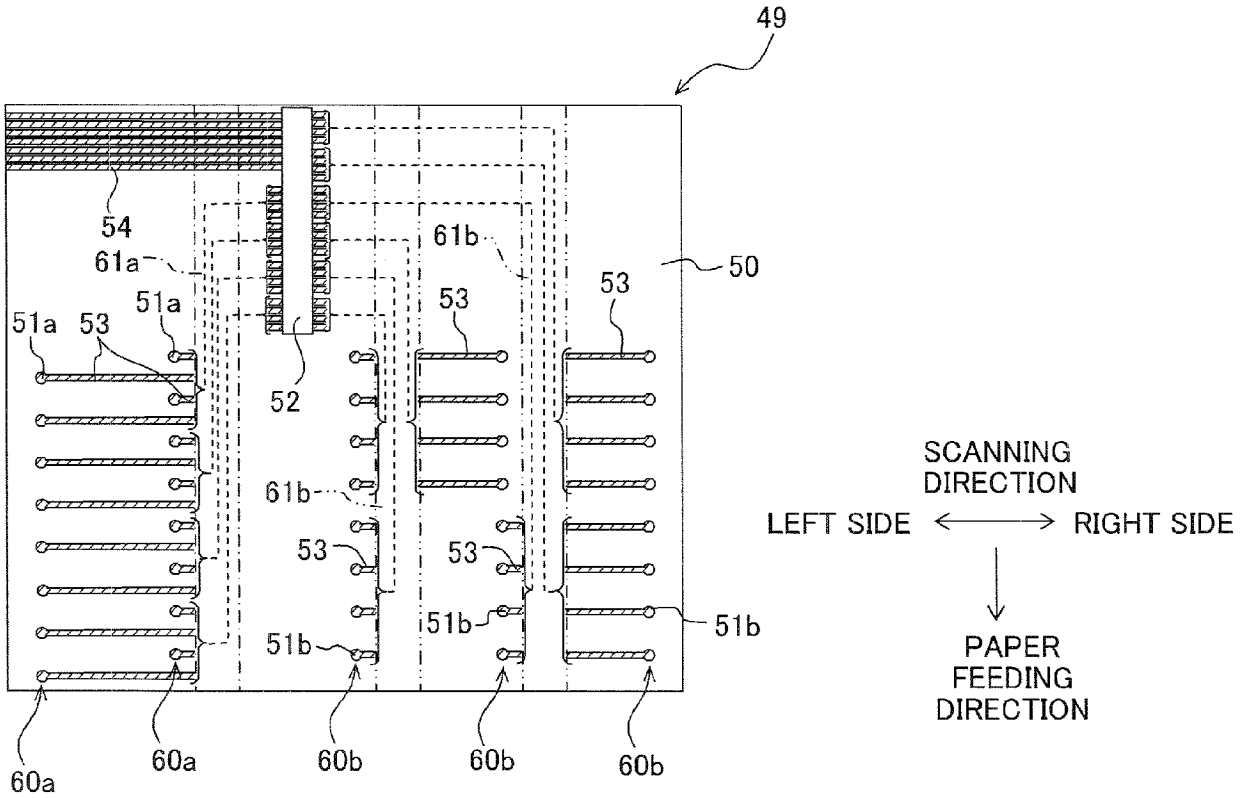
FIG. 4 is a plan view of a COF.

As shown in FIG. 3, the Chip On Film (COF) 49 (wiring board having flexibility) is disposed above the piezoelectric actuator 22. As shown in FIG. 4, the COF 49 includes, for example, a base member 50, a plurality of contact points 51*a* and 51*b* (connecting portions), the driver IC 52, and a plurality of wiling lines 53 and 54. In FIG. 4, however, to make the diagram easily understandable, the contact points 51*a* and 51*b*, the driver IC 52, the wires 53 and 54, and the like, which will be described later and which are to be depicted by broken lines, are depicted by solid lines; and further, the contact points 51*a* and 51*b* and the wires 53 and 54 are hatched.

The base member 50 is a film member made of the synthetic-resin material such as the polyimide and has a flexibility. The contact points 51*a* are arranged at portions, facing the connecting terminals 45*a*, on the lower surface of the base member 50 (connecting surface for connecting with the piezoelectric actuator 22). Accordingly, the contact points 51*a* are aligned in the paper feeding direction to form a contact point array 60*a*. In the COF 49, two contact point arrays 60*a* are arranged, corresponding to the two nozzle arrays 8*a*, in the scanning direction. Each of the contact points 51*a* is connected to one of the connecting terminals 45*a* via a solder 48.

The contact points 51*b* are arranged at portions, facing the connecting terminals 45*b*, on the lower surface of the base member 50. Accordingly, the contact points 51*a* are aligned in the paper feeding direction to form a contact point array 60*b*. In the base member 50, three contact point arrays 60*b* are arranged, corresponding to the three nozzle arrays 8*b*, in the scanning direction. Each of the contact points 51*b* is connected to one of the connecting terminals 45*b* via the solder 48.

Corresponding to the arrangements of the contact points 51*a* and 51*b*, the COF 49 is formed with a protrusion (projection) 61*a* (first protrusion) and a protrusion (projection) 61*b* (second protrusion), which are bent to project upward (the side opposite to the connecting surface for connecting with the piezoelectric actuator 22) in a mountain shape, at a portion between the contact point array 60*a* and the contact point array 60*b* disposed to be adjacent to each other and a portion between two contact point arrays 60*b* disposed to be adjacent to each other, respectively. That is, the COF 49 is bent so that a portion at which the protrusions 61*a* and 61*b* are formed and a portion at which the protrusions 61*a* and 61*b* are not formed are arranged alternately in the scanning direction. Further, a protrusion amount H1 of the protrusion 61*a* is greater than a protrusion amount H2 of the protrusion 61*b*. The protrusion amount H1 of the protrusion 61*a* is about 0.1 to 0.5 mm.

The driver IC 52 has a substantially rectangular shape, which is elongated in the paper feeding direction, in a plane view (elongate shape) and is arranged on the lower surface of the base member 50 between the protrusions 61*a* and 61*b* disposed to be adjacent to each other.

The wires 53 are formed on the lower surface of the base member 50 and connect the contact points 51*a* and 51*b* and the driver IC 52. In FIG. 4, although an intermediate portion of each wire 53 is illustrated simplistically, wires 53, of the plurality of wires 53, connecting the contact points 51*a* and the driver IC 52 are drawn to pass through the protrusion 61*a*. Further, wires 53, of the plurality of wires 53, connecting the contact points 51*b* and the driver IC 52 are drawn to pass through at least one of the protrusions 61*b*.

The wires 54 are formed on the lower surface of the base member 50 and connect the driver IC 52 and an unillustrated Flexible Printed Circuit (FPC) connected to an unillustrated control hoard for controlling operation of the driver IC 52. Although illustration is omitted in FIG. 4, the COF 49 further includes a wire connected to the common electrode 43 formed on the base member 50, and the like, in addition to the wires 53 and 54.

The lower surface of the base member 50 other than the portions at which the contact points 51*a* and 51*b* are formed is insulated by a resist.

A shape retaining member 55 is arranged above the COF 49. The shape retaining member 55 is a substantially rectangular parallelepiped shape made of the metallic material and extends in the scanning direction and the paper feeding direction across the entire length of the portion, of the COF 49, facing the piezoelectric actuator 22. The length of the shape retaining member 55 in the scanning direction is substantially same as the distance between the connecting terminal array 46*a* disposed on the left side and the connecting terminal array 46*b* disposed on the rightmost side in FIG. 2. Further, recess portions 55*a* and 55*b*, in which the protrusions 61*a* and 61*b* are accommodated respectively, are formed on the lower surface of the shape retaining member 55, at portions facing the protrusions 61*a* and 61*b*. The protrusions 61*a* and 61*b* accommodated in the recess portions 55*a* and 55*b* are maintained in a state of being bent by side walls of the recess portions 55*a* and 55*b*.

The shape retaining member 55 makes contact with the upper surface of the base member 50. Accordingly, heat generated in the driver IC 52 is transmitted to the shape retaining member 55 via the base member 50 to be released from the shape retaining member 55 to the outside. That is, in this embodiment, the shape retaining member 55 also functions as a heat sink for releasing the heat generated in the driver IC 52 to the outside.

In the printer 1 as described above, the wires 53 of the COF 49 are provided individually with respect to the nozzles 15*a* and 15*b*. Thus, as the number of nozzles 15*a* and 15*b* in the ink-jet head 3 increases, the number of wires 53 increases. Therefore, in a case that many wires 53 are arranged in the base member 50 having a small area, it is not possible to ensure an enough spacing distance between the wires 53 and problems such as short-circuit between the wires 53 are more likely to occur.

Figure 5:
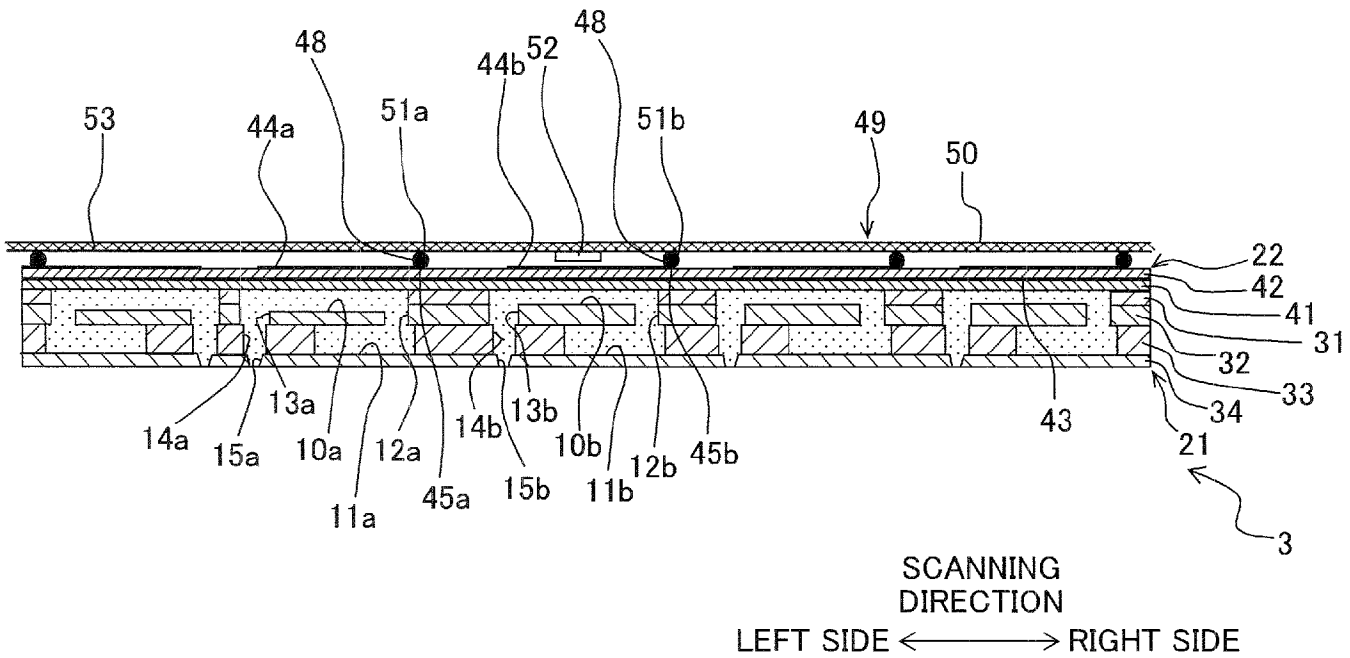
FIG. 5 is a diagram showing a case in which no protrusion is formed in the COF.

In this embodiment, as described above, the protrusions 61*a* and 61*b* are provided in the COF 49 and a part of each of the wires 53 is arranged in the protrusions 61*a* and 61*b*. Therefore, as compared with a case as shown in FIG. 5 which is different from this embodiment in that the protrusions 61*a* and 61*b* are not provided in the COF 49, the base member 50 of this embodiment has a longer length of the portion between the contact point array 60*a* and the contact point array 60*b* disposed to be adjacent to each other and a longer length of the portion between two contact point arrays 60*b* disposed to be adjacent to each other, in a direction which is parallel to a planar direction of the base member 50 and is perpendicular to the paper feeding direction (direction in which the contact points 51*a* and 51*b* are aligned). Thus, the surface area of the base member 50, at which the wires 53 can be arranged, becomes large in proportion to the longer lengths. Therefore, even when there are many nozzles 15*a* and 15*b* and even when many wires 53 are formed in the base member 50, it is possible to draw the wires 53 while ensuring the enough spacing distance between the wires 53.

In this embodiment, the number of contact points 51*a* corresponding to the nozzles 15*a* from which the black ink is discharged is greater than the number of contact points 51*b* corresponding to the nozzles 15*b* from which the yellow ink is discharged, the number of contact points 51*b* corresponding to the nozzles 15*b* from which the cyan ink is discharged, and the number of contact points 51*b* corresponding to the nozzles 15*b* from which the magenta ink is discharged. Therefore, the number of wires 53, each of which is partially arranged in the protrusion 61*a* and connected to one of the contact points 51*a*, is greater than the number of wires 53, each of which is partially arranged in one of the protrusions 61*b* and connected to one of the contact points 51*b*.

In view of this, in this embodiment, as described above, the protrusion 61*a*, which is provided between the contact point array 60*a* on the right side and the contact point array 60*b* disposed to be adjacent to the contact point array 60*a* and in which a part of each of the wires 53 connected to one of the contact points 51*a* is arranged, projects greater than each of the protrusions 61*b*, which is provided between the contact point arrays 60*b* disposed to be adjacent to each other and in which a part of each of the wiling lines 53 connected to one of the contact points 51*b* is arranged. Accordingly, the surface area of the protrusion 61*a* is greater than the surface area of each of the protrusions 61*b*, and thereby making it possible to draw any of the wires 53 connected to the contact points 51*a* and the wires 53 connected to the contact points 51*b* while ensuring the spacing distance between the wiling lines 53 reliably.

In this embodiment, the contact points 51*a* and 51*b* are aligned in the paper feeding direction, respectively, and the base material 50 is bent so that the concavity and convexity are arranged in the scanning direction perpendicular to the paper feeding direction (orthogonal direction). Accordingly, it is possible to form the protrusions 61*a* and 61*b* in the COF 49 efficiently.

In this situation, the contact points 51*a* and 51*b* are joined to the connecting terminals 45*a* and 45*b* of the piezoelectric actuator 22, and the protrusions 61*a* and 61*b* can be formed at portions, of the COF 49, which are between the contact point arrays 60*a* and 60*b* and which are not joined to the piezoelectric actuator 22.

In this embodiment, the driver IC 52 can be installed, on the base member 50 which forms the protrusions 61*a* and 61*b*, at a portion positioned between the protrusions 61*a* and 61*b*. In this situation, since the driver IC 52 has the substantially rectangular shape, in a plane view, which is elongated in the paper feeding direction, even when the spacing distance between the protrusions 61*a* and 61*b* is narrow, it is possible to install the driver IC 52 between the protrusions 61*a* and 61*b*.

Here, in a case that heat generated in the driver IC 52 is transmitted to the ink-jet head 3, viscosity of the ink is changed and jetting characteristic of the ink from each of the nozzles 15*a* and 15*b* is changed. Thus, unlike this embodiment, if the driver IC 52 is installed, on the base member 50, at a portion between two protrusions 61*b* disposed to be adjacent to each other, the driver IC 52 is disposed in the vicinity of the pressure chambers 10*b* and the nozzles 15*b* from which the inks of cyan and magenta having deeper colors than the yellow ink are jetted. Thus, the jetting characteristics of the inks of cyan and magenta are more likely to be changed. In a case that the jetting characteristics of the inks of cyan and magenta are changed, change of color occurred when color printing is performed becomes conspicuous.

In view of the above, in this embodiment, the driver IC 52 is installed, on the base member 50, at a portion between the protrusions 61*a* and 61*b* disposed to be adjacent to each other. In this case, the driver IC 52 is arranged at a position near the pressure chambers 10*b* and the nozzles 15*b* from which the yellow ink is discharged. Thus, the jetting characteristics of the inks of cyan and magenta are less likely to be changed as compared with the above case. In this case, although the jetting characteristic of the yellow ink is more likely to be changed, the yellow ink has a lighter color than the inks of cyan and magenta. Therefore, in this embodiment, the change of color, occurred when color printing is performed, due to the influence of the heat generated in the driver IC 52 is inconspicuous as compared with the above case.

In this embodiment, as described above, the shape retaining member 55 is arranged above the COF 49. The protrusions 61*a* and 61*b* are accommodated in the recess portions 55*a* and 55*b* formed in the shape retaining member 55, and the protrusions 61*a* and 61*b* are supported by the wall surfaces of the recess portions 55*a* and 55*b* to maintain the shapes thereof. Therefore, deformation of the protrusions 61*a* and 61*b* due to, for example, aging degradation of the base member 51 can be prevented. Accordingly, it is possible to prevent the contact between the wires 53 occurred by making the protrusions 61*a* and 61*b* come contact with any other portion.

Further, in this situation, the shape retaining member 55 is formed of a metallic material and also functions as the heat sink for releasing the heat generated in the driver IC 52 to the outside. Thus, it is possible to downsize the apparatus without providing the heat sink additionally.

Figure 6A:
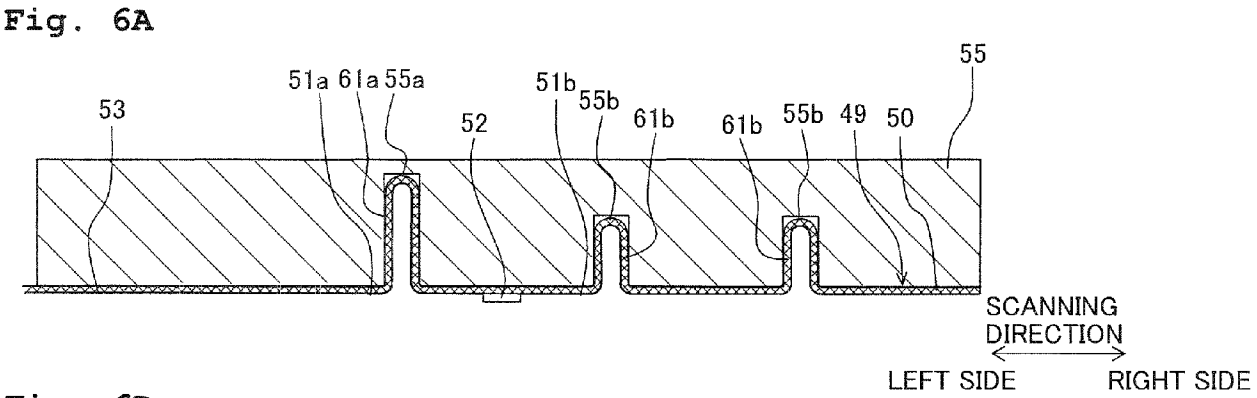
FIGS. 6A and 6B are diagrams showing a joining procedure for joining the ink-jet head and the COF.

Next, an explanation will be made about a method for joining the ink-jet head 3 and the COF 49 in the production of the printer 1. In order to join the ink-jet head 3 and the COF 49, at first, as shown in FIG. 6A, the portion between the contact point array 60*a* and the contact point array 60*b* disposed to be adjacent to each other and the portion between two contact point arrays 60*b* disposed to be adjacent to each other, of the COF 49, are bent, toward the side opposite to the contact points 51*a* and 51*b* in a direction perpendicular to a planar direction of the COF 49, to have a mountain shape as viewed in the alignment direction of the contact points 51*a* and 51*b*, thereby forming the protrusions 61*a* and 61*b*. Further, the protrusions 61*a* and 61*b* are accommodated in the recess portions 55*a* and 55*b* of the shape retaining member 55 in parallel with formation of the protrusions 61*a* and 61*b*.

Here, a length of the portion, of the COF 49, positioned between the contact point array 60*a* and the contact point array 60*b* disposed to be adjacent to each other in a direction parallel to the planar direction of the COF 49 and perpendicular to the alignment direction of the contact points 51*a* and 51*b* is longer than a distance, in the scanning direction, between the connecting terminal array 46*a* and the connecting terminal arrays 46*b* disposed to be adjacent to each other. Further, a length of the portion, of the COF 49, positioned between the two contact point arrays 60*b* disposed to be adjacent to each other in the direction parallel to the planar direction of the COF 49 and perpendicular to the alignment direction of the contact points 51*a* and 51*b* is longer than a distance, in the scanning direction, between the two connecting terminal arrays 46*b* disposed to be adjacent to each other. In this embodiment, the distance between the contact point array 60*a* and the contact point array 60*b* disposed to be adjacent to each other is made to be short by bending the COF 49, and thereby the distance between the contact point array 60*a* and the contact point array 60*b* is made to have the same distance as the distance between the connecting terminal array 46*a* and the connecting terminal array 46*b* disposed to be adjacent to each other. Similarly, in this embodiment, the distance between two contact point arrays 60*b* disposed to be adjacent to each other is made to be short by bending the COF 49, and thereby the distance between two contact point arrays 60*b* is made to have the same distance as the distance between two connecting terminal arrays 46*b* disposed to be adjacent to each other. Further, in this situation, a thermosetting adhesive is applied between the COF 49 and the shape retaining member 55.

Figure 6B:
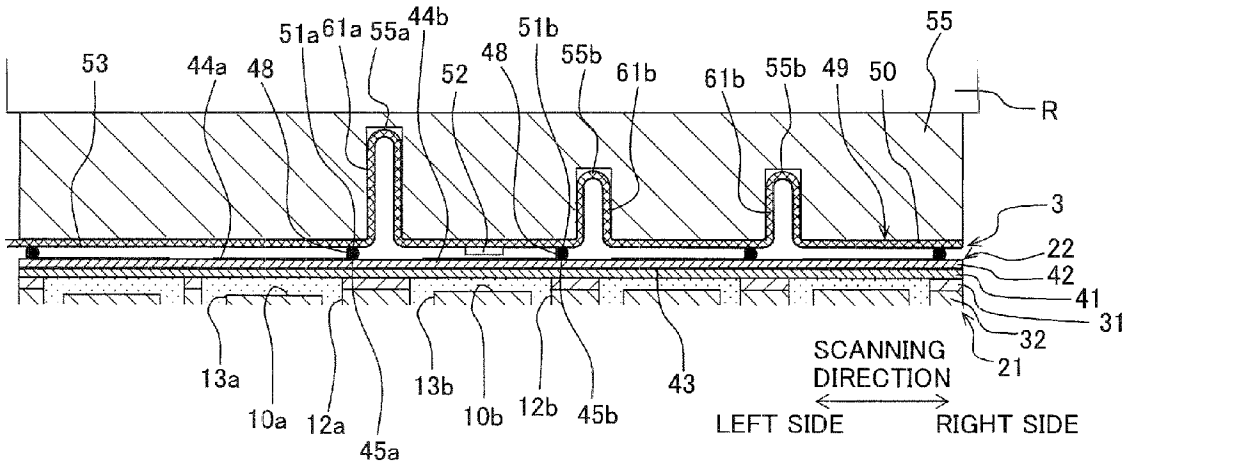

Next, as shown in FIG. 6B, the connection terminals 45*a*, 45*b* and the contact points 51*a*, 51*b* are joined by the solders 48 (joining step) as follows. That is, a stacked body of the COF 49 and the shape retaining member 55 is disposed, on the upper surface of the ink-jet head 3 in which the solders 48 have been formed in the connection terminals 45*a*, 45*b*, so that the COF 49 faces the ink-jet head 3. Then, the shape retaining member 55 and the COF 49 are pressed while being heated from above the shape retaining member 55 by a heater R. In this situation, the piezoelectric layer 42 has a linear expansion coefficient different from that of the COF 49, and thus difference of amount of extension/contraction occurs between the piezoelectric layer 42 and the COF 49. In this embodiment, however, it is possible to absorb the difference of the amount of extension/contraction between the piezoelectric layer 42 and the COF 49 by deformation of the protrusions 61*a* and 61*b* which have been bent.

Further, in this situation, the COF 49 and the shape retaining member 55 are joined by the thermosetting adhesive (the shape retaining member 55 is joined to the piezoelectric actuator 22 together with the COF 49). Accordingly, it is possible to retain the shapes of the protrusions 61*a* and 61*b* after joining the ink-jet head 3 and the COF 49.

Next, modified embodiments in which various modifications are made in the embodiment will be described below. However, the description of components having the same structure as in the embodiment is appropriately omitted.

Figure 7:
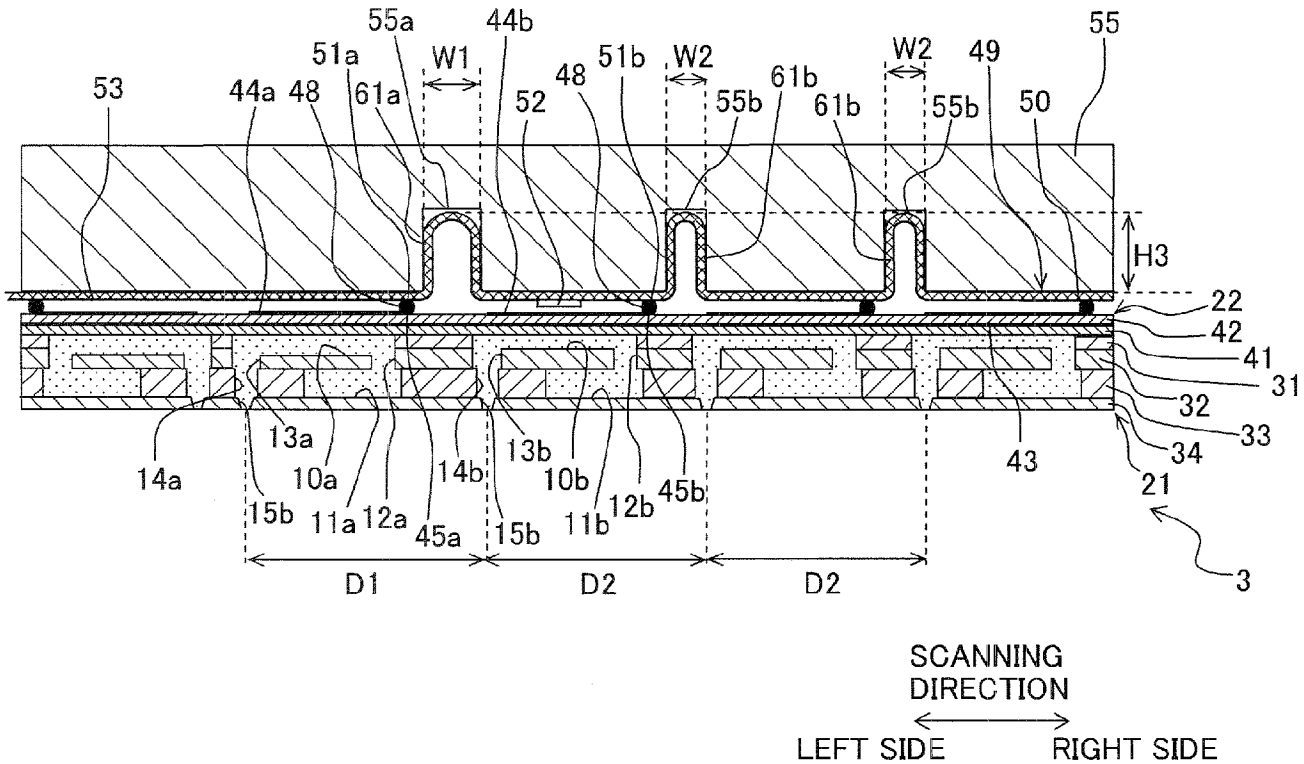
FIG. 7 is a diagram of the first modified embodiment which corresponds to FIG. 3.

In the above embodiment, the protrusion amount H1 of the protrusion 61*a* is made to be greater than the protrusion amount H2 of each protrusion 61*b*, and thus the surface area of the protrusion 61*a* is made to be greater than the surface area of each protrusion 61*b*. The present teaching, however, is not limited thereto. In a modified embodiment (the first modified embodiment), as shown in FIG. 7, the protrusions 61*a* and 61*b* each have an protrusion amount H3, and a width W1 of the protrusion 61*a* in the scanning direction is greater than a width W2 of each protrusion 61*b* in the scanning direction. Also in this case, similar to the above embodiment, the surface area of the protrusion 61*a* can be made to be greater than the surface area of each protrusion 61*b*.

In the above embodiment, the cap portion 5*a* covering the nozzles 15*a* and the cap portion 5*b* covering the nozzles 15*b* are provided separately in the purge cap 5 as described above. Thus, a partition wall separating the cap portion 5*a* from the cap portion 5*b* is provided at a portion positioned between the nozzles 15*a* forming the nozzle array 8*a* disposed on the right side and the nozzles 15*b* forming the nozzle array 8*b* disposed on the leftmost side in the purge cap 5. Accordingly, a spacing distance D1 between the nozzles 15*a* forming the nozzle array 8*a* disposed on the right side and the nozzles 15*b* forming the nozzle array 8*b* disposed on the leftmost side is greater than a spacing distance D2 between the nozzles 15*b* forming two nozzle arrays 8*b* disposed to be adjacent to each other. Therefore, it is possible to provide the protrusion 61*a* having a great width in the scanning direction between the contact point array 60*a* provided corresponding to the nozzle array 8*a* disposed on the right side and the contact point array 60*b* provided corresponding to the nozzle array 8*b* disposed on the leftmost side.

In the above embodiment, the surface area of the protrusion 61*a* is greater than the surface area of each protrusion 61*b*. The present teaching, however, is not limited thereto. For example, in a case that the number of the nozzles 15*a* through which the black ink is jetted is substantially equal to each of the number of nozzles 15*b* through which the yellow ink is jetted, the number of nozzles 15*b* through which the cyan ink is jetted, and the number of nozzles 15*b* through which the magenta ink is jetted, the surface area of the protrusion 61*a* may be substantially equal to the surface area of each protrusion 61*b*.

Figure 8:
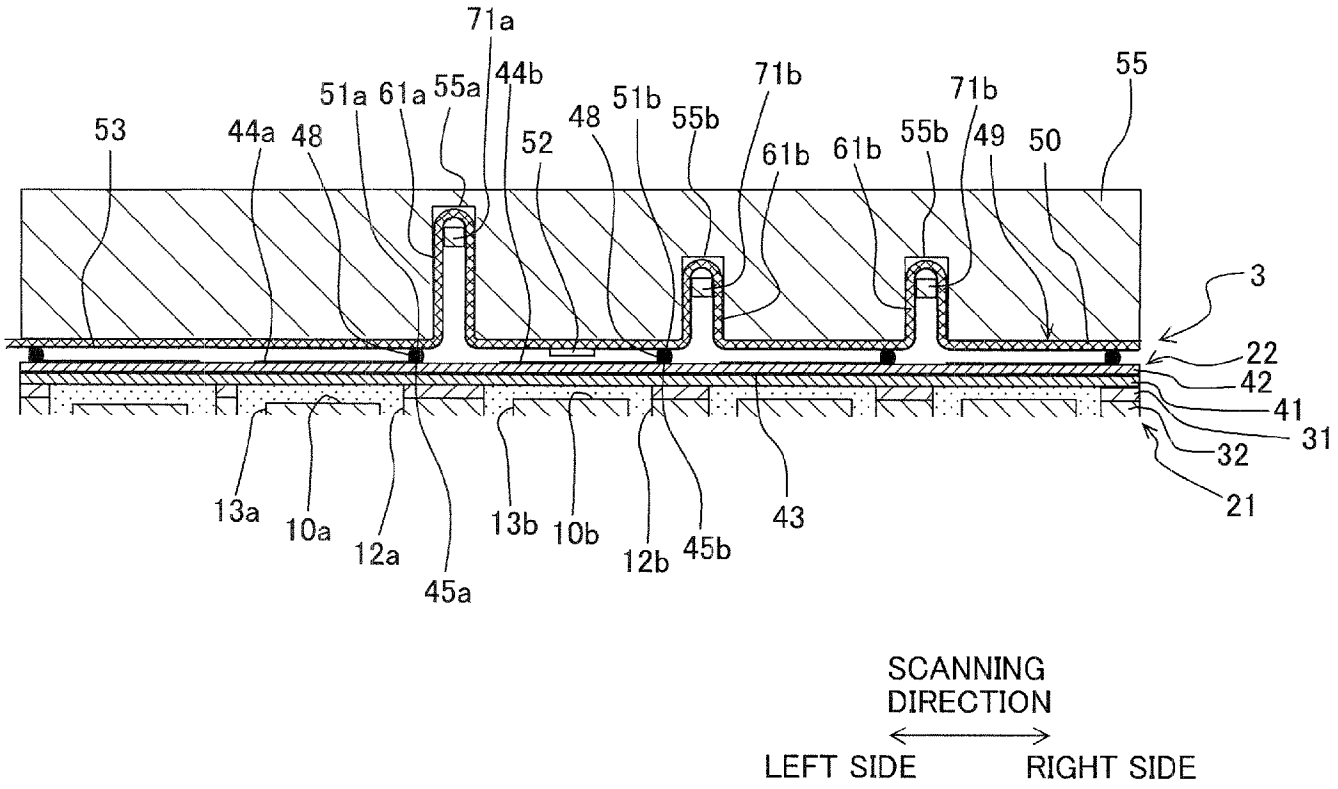
FIG. 8 is a cross-sectional view of a joining portion between an ink-jet head and a COF of the second modified embodiment along a scanning direction.

In the above embodiment, the protrusions 61*a* and 61*b* are each maintained in a shape of being bent only by being supported by the surfaces of the side walls of the recess portions 55*a* and 55*b* formed in the shape retaining member 55. The present teaching, however, is not limited thereto. In another modified embodiment (second modified embodiment), as shown in FIG. 8, there are further provided, in the shape retaining member 55, support portions 71*a* and 71*b* which support, from below, portions in the vicinity of the top portions of the protrusions 61*a* and 61*b*, and which extend in a paper feed direction (direction perpendicular to the paper surface of FIG. 8) and are bent to have the mountain shape in the recess portions 55*a* and 55*b*, respectively.

In the second modified embodiment, in a case that the protrusions 61*a* and 61*b* are accommodated in the recess portions 55*a* and 55*b*, respectively, it is necessary that the protrusion 61*a* passes between the wall of the recess portion 55*a* and the support portion 71*a* and that the protrusion 61*b* passes between the wall of the recess portion 55*b* and the support portion 71*b*. Thus, as compared with the above embodiment, a step for connecting the piezoelectric actuator 22 and the COF 49 becomes complex in some degree. In the second modified embodiment, however, the support portions 71*a* and 71*b* regulate that the portions in the vicinity of the top portions of the protrusions 61*a* and 61*b* go downward, and thereby making it possible to reliably prevent the protrusions 61*a* and 61*b* accommodated in the recess portions 55*a* and 55*b* from being deformed.

In the second modified embodiment, in order that the wires 53, which are arranged on both sides with the top portions of the protrusions 61*a* and 61*b* intervening therebetween, are prevented from being in electrical conduction with each other via the support portions 71*a* and 71*b*, for example, it is preferable that a film made of an insulating material is formed on each of the surfaces of the support portions 71*a* and 71*b*, or that the shape retaining member 55 including the support portions 71*a* and 71*b* is formed by the insulating material. However, in a case that the shape retaining member 55 is formed by the insulating material, it is necessary, for example, to provide the heat sink separately.

Figure 9:
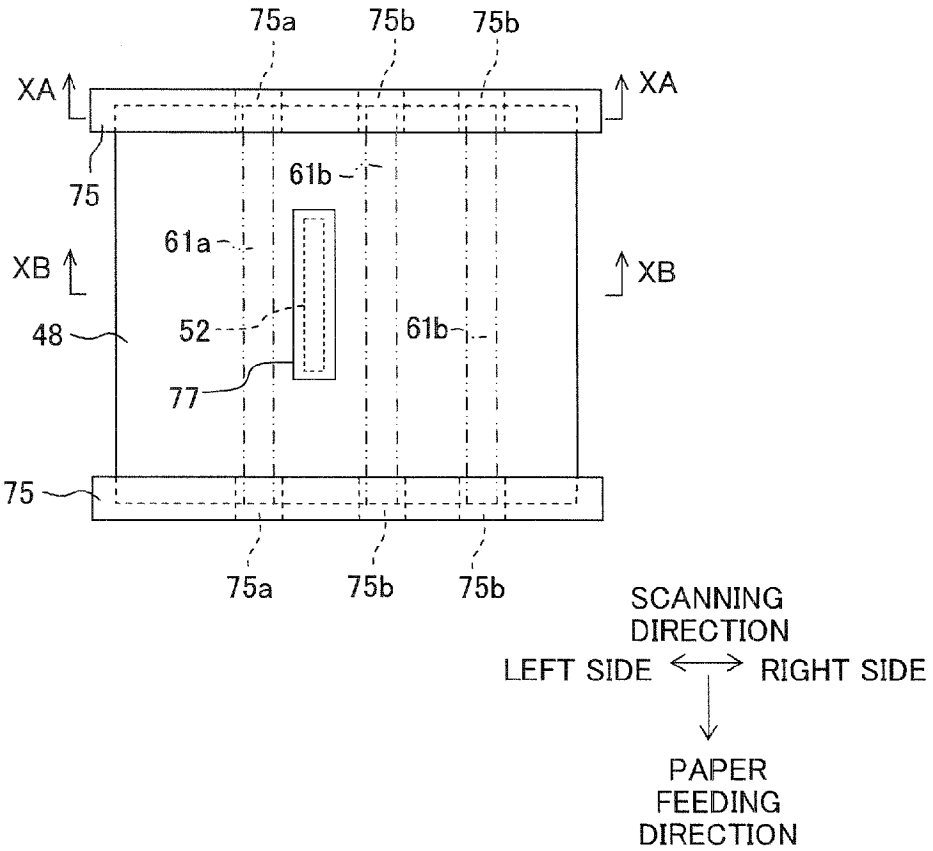
FIG. 9 is a plan view of a COF and a shape retaining member of the third modified embodiment.
Figure 10A:
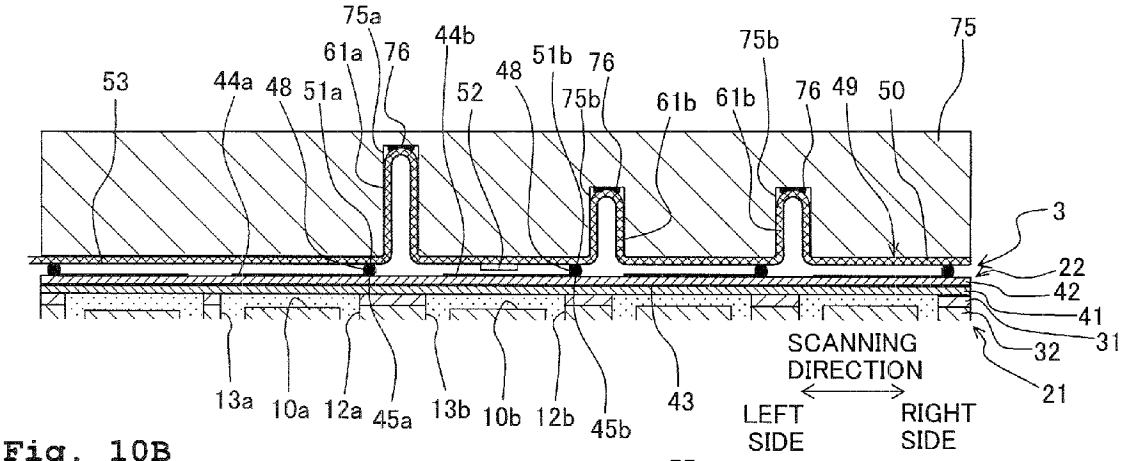
FIG. 10A is a cross-sectional view taken along a line XA-XA in FIG. 9.
Figure 10B:
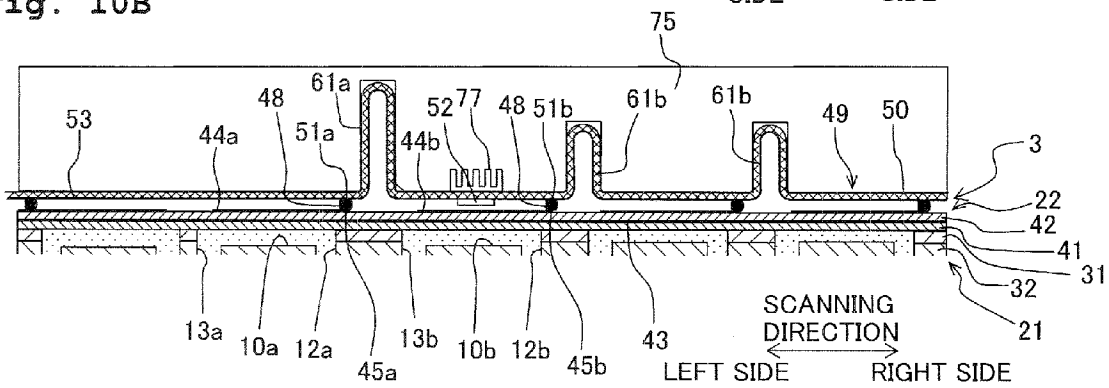
FIG. 10B is a cross-sectional view taken along a line XB-XB in FIG. 9.

In the above embodiment, the shape retaining member 55 extends across the entire length of the COF 49 in the scanning direction and the paper feeding direction. The present teaching, however, is not limited thereto. In still another modified embodiment (third modified embodiment), as shown in FIGS. 9, 10A, and 10B, two shape retaining members 75 are disposed to face both end portions of the COF 49 in the paper feeding direction. Noted that, in order to make the view easy to see, illustrations of the contact points 51*a* and 51*b*, the wires 53, and the like of the COF 49 are omitted in FIG. 9.

Here, each of the shape retaining members 75 is a member in which recess portions 75*a* and 75*b* for accommodating the protrusions 61*a* and 61*b* respectively are formed at portions facing the protrusions 61*a* and 61*b*. The length in the paper feeding direction is shorter than that of the shape retaining member 55. Further, in the third modified embodiment, the top portions of the protrusions 61*a* and 61*b* are joined, by an adhesive 76, to the wall surfaces, on the upper side, of the recess portions 75*a* and 75*b*.

In the third embodiment, the driver IC 52 is installed at the substantially center portion of the base member 50 in the paper feeding direction, and a heat sink 77 is provided at a portion, of the upper surface of the base member 50, facing the driver IC 52.

In a case that only the both end portions of the protrusions 61*a* and 61*b* in the paper feeding direction are accommodated in the recess portions 75*a* and 75*b* as in the modified embodiment 3, if the protrusions 61*a* and 61*b* are not joined to the wall surfaces of the recess portions 75*a* and 75*b*, the protrusions 61*a* and 61*b* are displaced downward by the weight of a portion between the two shape retaining members 75 and there is fear that the shapes of the protrusions 61*a* and 61*b* can not be maintained. However, in the modified embodiment 3, the top portions of the protrusions 61*a* and 61*b* are joined to the wall surfaces of the recess portions 75*a* and 75*b*. Therefore, portions, of the protrusions 61*a* and 61*b*, accommodated in the recess portions 75*a* and 75*b* are not deformed downward and the shapes of the protrusions 61*a* and 61*b* can be maintained.

In the third modified embodiment, there is formed a space, at a portion, on the upper surface of the base member 50, between the two shape retaining members 75. Thus, as described above, it is possible to arrange the heat sink 77 at this space. In the third modified embodiment, since the heat sink 77 is provided in addition to the shape retaining member 75, the shape retaining member 75 may be formed of a metallic material which is the same as that of the shape retaining member 55 or formed of a material other than metal, such as the a synthetic-resin material.

In the above embodiment, the shape retaining member includes the recess portions in which the protrusions 61*a* and 61*b* are accommodated, and the walls of the recess portions support the protrusions 61*a* and 61*b* to maintain the shapes of the protrusions 61*a* and 61*b*. The present teaching, however, is not limited thereto. The shape retaining member may be a member having another shape which is capable of retaining the shapes of the protrusions 61*a* and 61*b*. For example, a cross-sectional shape, viewed from the paper feeding direction, of each of the recess portions in which one of the protrusions 61*a* and 61*b* is accommodated may be triangle shape or a circular-arc shape.

Figure 11:
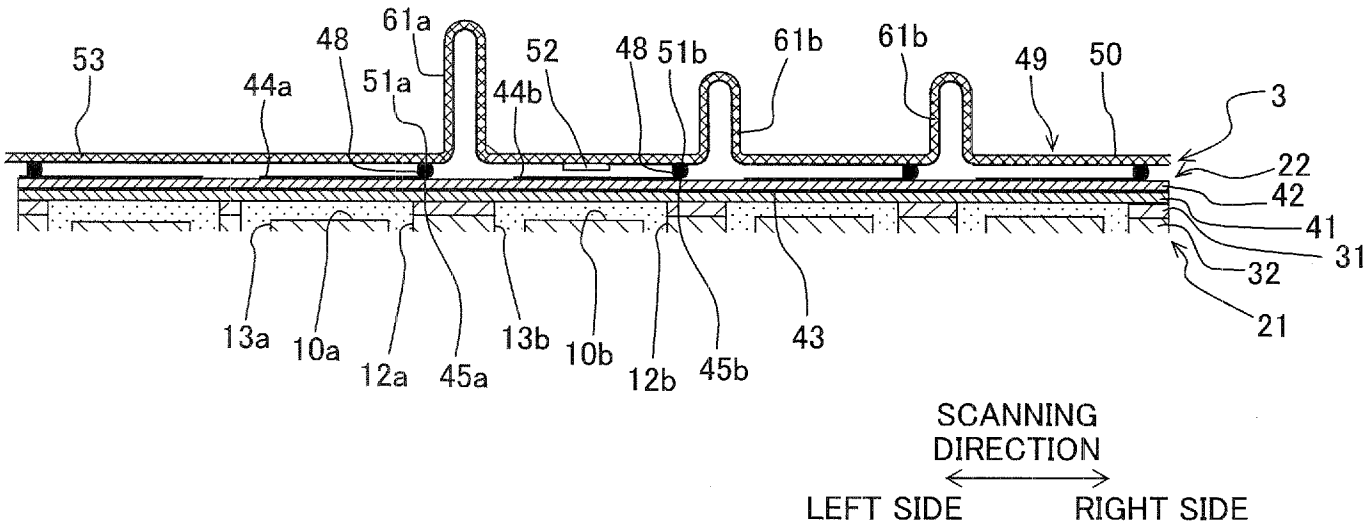
FIG. 11 is a diagram of the fourth modified embodiment which corresponds to FIG. 7.

In the above embodiment, in a case that the COF 49 is joined to the ink-jet head 3, the shape retaining member 55 is joined to the COF 49. The present teaching, however, is not limited thereto. For example, the following manner is also allowable. That is, the adhesive is not applied between the COF 49 and the shape retaining member 55 in the step of FIG. 6A; the ink-jet head 3 and the COF 49 are joined to each other as shown in FIG. 6B; and then, the shape retaining member 55 is removed as shown in FIG. 11 (fourth modified embodiment). In this case, the shapes of the protrusions 61*a* and 61*b* are retained by rigidity of the protrusions 61*a* and 61*b*.

In the above embodiment, the driver IC 52 is installed on the lower surface of the base member 50 and it is configured so that the heat generated in the driver IC 52 is released to the shape retaining member 55 which also functions as the heat sink. The present teaching, however, is not limited thereto. For example, the driver IC 52 may be installed on the upper surface of the base member 50 to make contact directly with the shape retaining member. In this case, for example, the driver IC 52 and the wires 53 may be connected to each other via through hole(s) formed through the base member 50.

In the above embodiment, the driver IC 52 has the substantially rectangular shape, in the plane view, elongated in the paper feeding direction. The present teaching, however, is not limited thereto. For example, in a case that a portion, of the base member 50, between the protrusions 61*a* and 61*b* disposed to be adjacent to each other is sufficiently long, the driver IC 52 may have a substantially square shape or a substantially rectangular shape, in the plane view, elongated in the scanning direction.

Figure 12A:
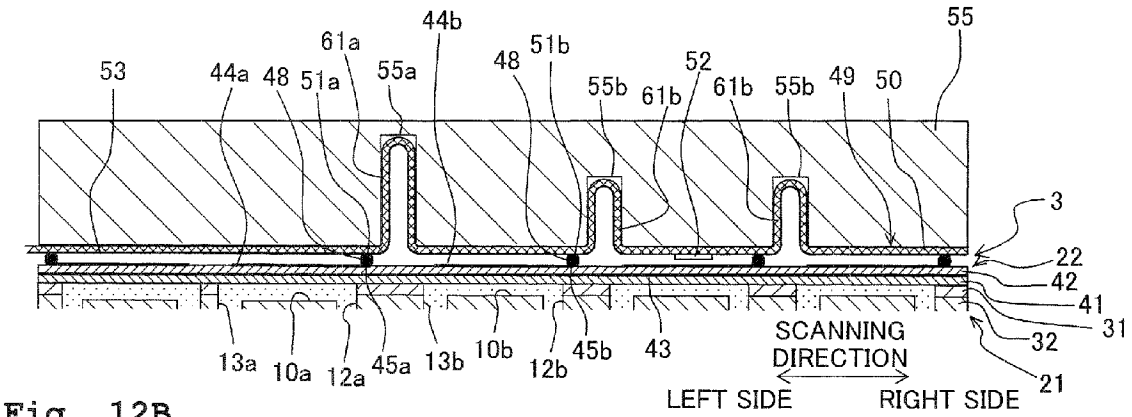
FIG. 12A is a diagram of the fifth modified embodiment which corresponds to FIG. 7.

In the above embodiment, the driver IC 52 is installed, on the base member 50, at the portion between the protrusions 61*a* and 61*b* disposed to be adjacent to each other. The present teaching, however, is not limited thereto. For example, as shown in FIG. 12A, the driver IC 52 may be installed, on the base member 50, at the portion between the two protrusions 61*b* disposed to be adjacent to each other (fifth modified embodiment).

Figure 12B:
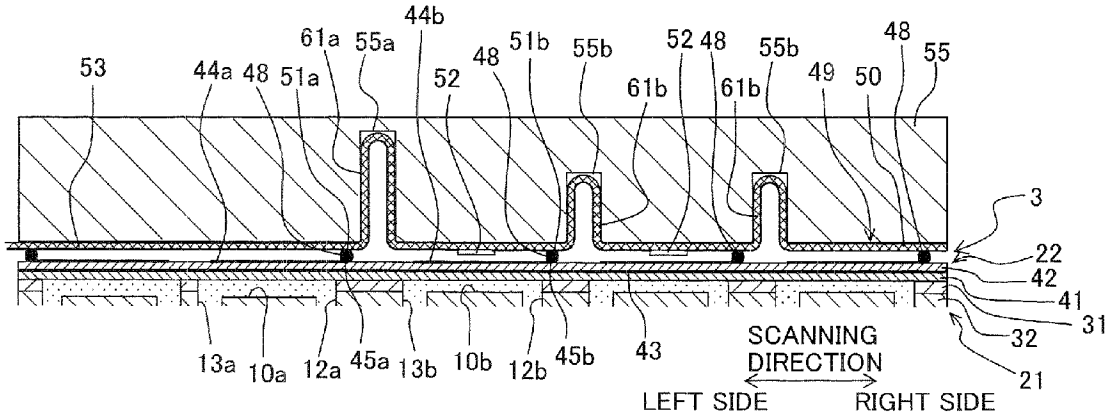
FIG. 12B is a diagram of the sixth modified embodiment which corresponds to FIG. 7.

Alternatively, as shown in FIG. 12B, the driver ICs 52 may be installed, on the base member 50, at both the portion between the protrusions 61*a* and 61*b* disposed to be adjacent to each other and the portion between the two protrusions 61*b* disposed to be adjacent to each other (sixth modified embodiment). In this case, since each of the wires 53 may be connected to any one of the two driver ICs 52, the number of wires 53 connected to one driver IC 52 is reduced. Therefore, it is possible to further downsize the driver IC 52 as compared with the above embodiment, and it is possible to arrange the driver IC 52 even when the spacing distance between the protrusions 61*a* and 61*b* is narrower.

Figure 13:
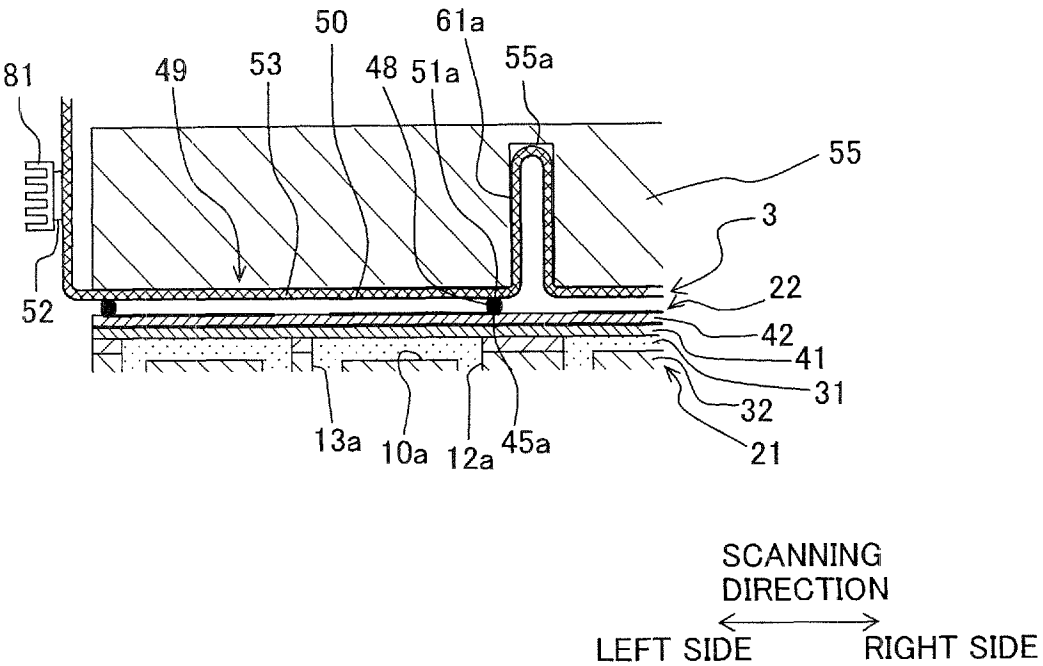
FIG. 13 is a cross-sectional view, along the scanning direction, of a left end portion in the scanning direction, of a joining portion between an ink-jet head and a COF of the seventh modified embodiment.
Figure 14:
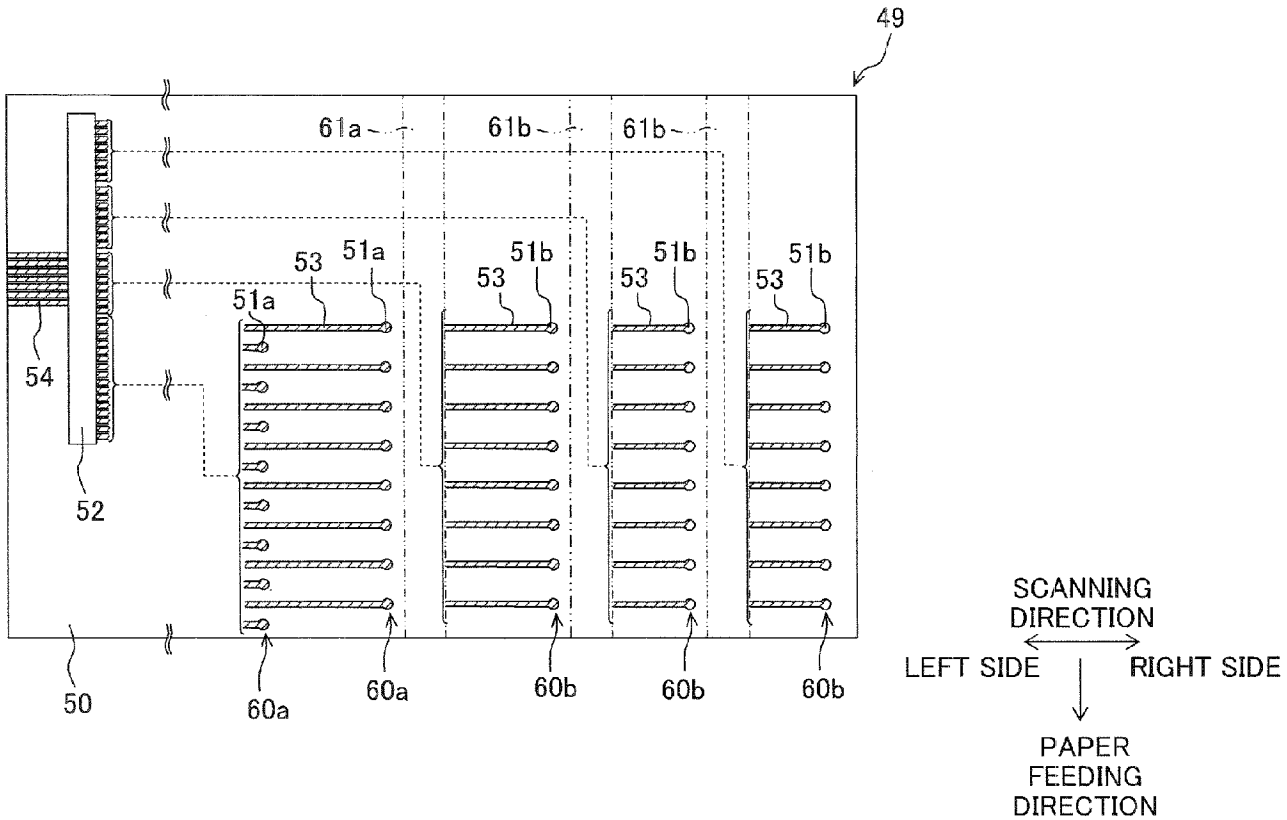
FIG. 14 is a diagram of the seventh modified embodiment which corresponds to FIG. 4.

Further, the present teaching is not limited to, that the driver IC 52 is installed, on the base member 50, at the portion between the protrusions 61*a* and 61*b* disposed to be adjacent to each other. For example, in yet another modified embodiment (seventh modified embodiment), as shown in FIG. 13, the base member 50 is drawn toward an upper side from a portion facing the piezoelectric actuator 22, and the driver IC 52 is installed at the portion drawn toward the upper side. In this situation, as shown in FIG. 14, the driver IC 52 is disposed such that portions connected to the contact points 51*a* overlap with the contact points 51*a* in the scanning direction. Further, corresponding to the position of the driver IC 52, all of the wires 53 connected to the contact points 51*a* and 51*b* are drawn toward a left side from the contact points 51*a* and 51*b*, and only the wires 53 connected to the contact points 51*b* pass through the protrusions 61*a* and 61*b*. Further, in addition to the shape retaining member 55, a heat sink 81 making contact with the driver IC 52 is provided.

In this case, the driver IC 52 is installed, on the base member 50, at the portion drawn toward the upper side from the portion facing the piezoelectric actuator 22. Thus, an area of a portion of the base member 50, positioned between the driver IC 52 and the contact points 51*a* is relatively large. Therefore, regarding the wires 53 connecting the driver IC 52 and the contact points 51*a* arranged in this area, it is possible to ensure the enough spacing distance between the wires 53 even when the wiling lines 53 are not drawn to the protrusions 61*a* and 61*b*. In the seventh modified embodiment, the wiling lines 53 connected to the contact points 51*a* as described above are drawn not to pass through the protrusion 61*a*. However, the wiling lines 53 may be drawn to pass through the protrusion 61*a*.

On the other hand, the wiling lines 53 connecting the driver IC 52 and the contact points 51*b* pass through a portion, positioned between the contact point arrays 60*a* and 60*b* disposed to be adjacent to each other, having a not-so-large spacing distance. Since there are provided the protrusions 61*a* and 61*b*, on the base member 50, at the portion between the contact point arrays 60*a* and 60*b* disposed to be adjacent to each other, it is possible to ensure the enough spacing distance between the wires 53 by forming a part of each of the wires 53 connecting the driver IC and the contact points 51*b* in the protrusions 61*a* and 61*b*.

In this case, the driver IC 52 is arranged so that a part of the driver IC 52 overlaps with the contact points 51*a* and 51*b* in the paper feeding direction. Thus, as compared with the case in which the driver IC 52 is arranged so that the entire driver IC 52 does not overlap with the contact points 51*a* and 51*b* in the paper feeding direction, it is possible to shorten the length of the COF 49 in the paper feeding direction. It is noted that, it is possible to further shorten the length of the COF 49 in the paper feeding direction provided that the driver IC 52 is arranged so that the entire driver IC 52 overlaps with the contact points 51*a* and 51*b* in the paper feeding direction. However, in this case, with respect to the paper feeding direction, since an area between the edge of the base member 50 and an area in which the contact points 51*a* are arranged is narrow, there is fear that it is difficult to draw the wires 53 connecting the driver IC 52 and the contact points 51*b* to pass through this area.

In the seventh embodiment, since the heat sink 81 is provided independently of the shape retaining member 55, the shape retaining member 55 may be formed of a material other than the metal, such as the synthetic-resin material.

In the seventh embodiment, the driver IC 52 is arranged so that a part of the driver IC 52 overlaps with the contact points 51*a* and 51*b* in the paper feeding direction. However, in a case that the COF 49 may get larger in the paper feeding direction, the driver IC 52 may be arranged so that the entire driver IC 52 does not overlap with the contact points 51*a* and 51*b* in the paper feeding direction.

Further, as in the modified embodiments 3 and 7, in a case that the heat sink is provided independently of the shape retaining member and that the shape retaining member is formed of the insulating material such as the synthetic resin, the wires 53 and 54 may be formed on the upper surface of the base member 50. In this case, for example, the contact points 51*a* and 51*b* and the wires 53 may be connected to each other via through hole(s) formed through the base member 50.

In the above embodiments, the protrusions 61*a* and 61*b* are formed at the portion between the contact point arrays 60*a* and 60*b* disposed to be adjacent to each other. The present teaching, however, is not limited thereto. For example, the protrusions may be provided, on the base member 50, at portions facing the piezoelectric actuator 22, positioned at a left side of the left-sided contact point array 60*a* and/or positioned at a right side of the contact point array 60*b* disposed on the rightmost side.

In the above embodiments, the plurality of contact point arrays 60*a* and 60*b* are provided on the base member 50. The present teaching, however, is not limited thereto. For example, the following configuration is also allowable. That is, only one contact point array is provided on the base member 50 and the protrusion is provided at a portion shifted in the scanning direction from the contact point array of the COF 49.

Further, the plurality of contact points 51*a* and 51*b* may not form the contact point arrays. In this case, the protrusions may be provided on the base member 50 at portions at which the contact points 51*a* and 51*b* are not formed. In this case, it is not limited to that the COF 49 is bent so that the concavity and convexity are arranged in the scanning direction. The COF 49 may be bent in an appropriate direction depending on the positions of the contact points 51*a* and 51*b*.

Figure 15:
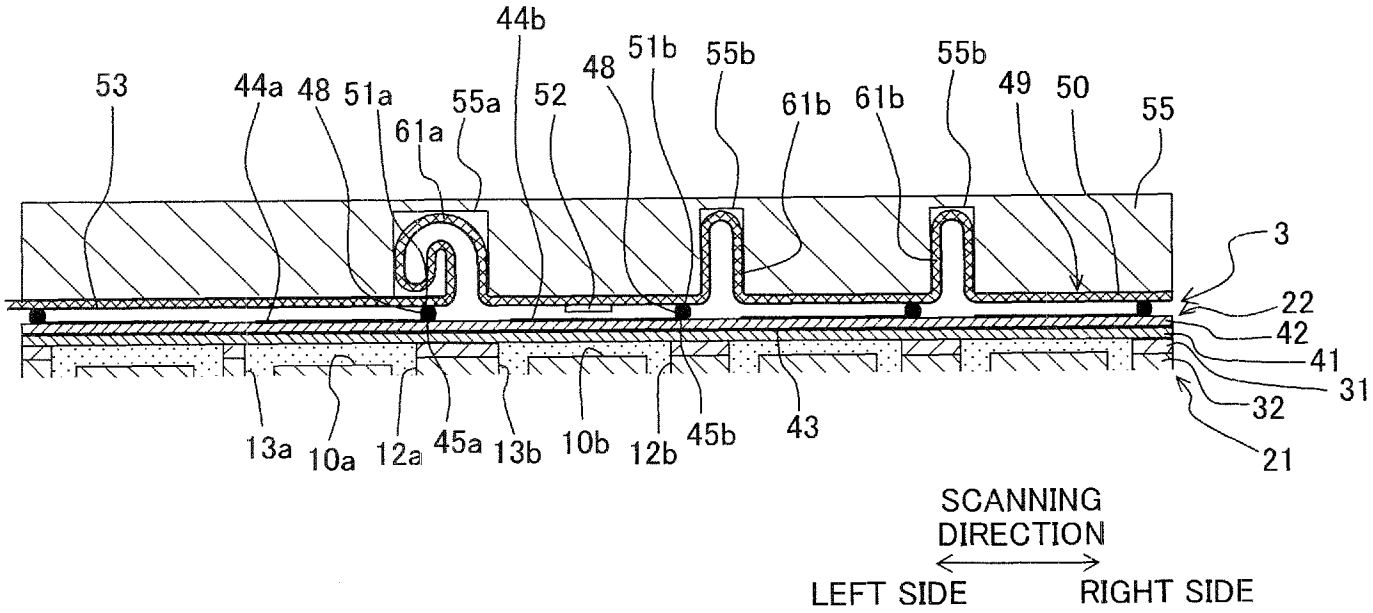
FIG. 15 is a diagram of the eighth modified embodiment which corresponds to FIG. 8.

In the above embodiment, the protrusions 61*a* and 61*b* are formed by bending the COF 49 to have the mountain shape. The present teaching, however, is not limited thereto. In one modified embodiment (eighth modified embodiment), for example, in a case that a length, in an up and down direction, of a space in which the COF 49 and the shape retaining member 55 can be arranged is shorter than that of the above embodiments, the following configuration may be employed. That is, as shown in FIG. 15, the protrusion 61*a* having the large protrusion amount is further bent at the intermediate portion thereof to have a low height; the shape retaining member 55 is made to have a low height; and the recess portion 55*a* is made to have a low height depending on the shape of the protrusion 61*a* and to have a larger width in the scanning direction.

In the eight embodiment, the explanation has been made about the case in which the length, in the up and down direction, of the space in which the COF 49 and the shape retaining member 55 can be arranged is short. For example, in a case that the protrusions 61*a* and 61*b* are made to have longer length than those of the above embodiments, the protrusions 61*a* and 61*b* may be bent at the intermediate portion thereof to prevent that the heights of the protrusions 61*a* and 61*b* and the shape retaining member 55 are too high.

It is noted that, the number of times, positions, orientations, and the like, for which the protrusions 61*a* and 61*b* are bent in the respective intermediate portions can be changed as appropriate depending on, for example, sizes of the protrusions 61*a* and 61*b* and the space in which each of the protrusions 61*a*, 61*b* and the shape retaining member 55 are arranged.

In the above embodiments, the ink-jet head 3 is provided with the piezoelectric actuator which applies the pressure to the inks in the pressure chambers 10*a* and 10*b* communicating with the nozzles 15*a* and 15*b* by deforming the vibration plate 41 and the piezoelectric layer 42. The present teaching, however, is not limited thereto. The ink-jet head may be provided with an actuator other than the piezoelectric actuator applying jetting energy to the inks in the nozzles 15*a* and 15*b*.

In the above description, the explanation has been made about the case in which the present teaching is applied to the ink-jet printer provided with, a so-called serial head configured to jet the ink from the nozzles while moving reciprocatingly in the scanning direction. The present teaching, however, is not limited thereto. The present teaching is applicable to an ink-jet printer provided with a so-called line head configured to extend over the substantially entire length of the recording paper sheet P in the scanning direction.

In the above embodiment, the explanation has been made about the case in which the present teaching is applied to the printer provided with the ink-jet head 3 configured so that the black ink is jetted from the nozzles 15*a* and the color inks are jetted from the nozzles 15*b*. The present teaching, however, is not limited thereto. For example, the present teaching is also applicable to a printer provided with an ink-jet head configured so that a black pigment ink is jetted from the nozzles 15*a* and black and color dye inks are jetted from the nozzles 15*b*.

Alternatively, the present teaching is also applicable to an ink-jet printer provided with an ink-jet head configured to jet only one type of ink, such as an ink-jet head jetting only the black ink. Further, the present teaching is also applicable to a liquid jetting apparatus configured to jet a liquid other than the ink.

Further, the present teaching is also applicable to an apparatus other than the liquid jetting apparatus. In particular, the present teaching is applicable to an actuator device, used in any apparatus other than the liquid jetting apparatus, including an actuator and a flexible wiring board connected to the actuator.

What is claimed is:

1. A liquid jetting apparatus, comprising:

a channel unit formed with a plurality of nozzles and a plurality of liquid channels communicating with the nozzles;

an actuator including:

a plurality of drive sections, which are provided to correspond to the nozzles respectively, include a plurality of connecting terminals, and are configured to apply jetting energy to a liquid in the liquid channels; and a flexible wiring member including:

a plurality of connecting portions joined to the plurality of connecting terminals of the actuator respectively; and a plurality of wires connected to the connecting portions respectively;

wherein the flexible wiring member includes a protrusion formed by bending a portion of the flexible wiring member, at which at least a part of the plurality of wires is formed and which is different from a portion formed with the connecting portions, in a mountain shape to project in a direction, which intersects and is away from a connecting surface, of the flexible wiring member, for connecting with the actuator;

wherein the nozzles form a nozzle array extending in a predetermined first direction parallel to a first connecting surface, of the actuator, for connecting with the flexible wiring member;

wherein the connecting terminals and the connection portions form a connecting terminal array and a connecting portion array respectively, each of which extends in the first direction to correspond to the nozzle array; and wherein the protrusion is formed as a plurality of protrusions by bending the flexible wiring member so that a concavity and a convexity are arranged in a second direction, which is parallel to the first connecting surface of the actuator and which is perpendicular to the first direction.

2. The liquid jetting apparatus according to claim 1;

wherein the nozzle array is formed as a plurality of nozzle arrays arranged in the second direction;

wherein the connecting terminal array is formed as a plurality of connecting terminal arrays arranged in the second direction;

wherein the connecting portion array is formed as a plurality of connecting portion arrays arranged in the second direction; and wherein each of the protrusions is formed to project from a portion, of the flexible wiring member, which is positioned between the connecting portion arrays arranged to be adjacent to each other in the second direction.

3. The liquid jetting apparatus according to claim 1, further comprising:

a shape retaining member configured to retain a shape of the protrusion.

4. The liquid jetting apparatus according to claim 3;

wherein the shape retaining member is formed of a metallic material; and wherein the flexible wiring member makes contact with the shape retaining member.

5. The liquid jetting apparatus according to claim 1;

wherein a driver IC configured to drive the drive sections is installed at a portion positioned between two protrusions, of the protrusions, arranged to be adjacent to each other.

6. The liquid jetting apparatus according to claim 5;

wherein the driver IC has an elongate shape elongated in the first direction.

7. The liquid jetting apparatus according to claim 3;

wherein the nozzles form:

a first nozzle array extending in the first direction and through which a first ink is jetted; and a plurality of second nozzle arrays each extending in the first direction and through which a second ink different from the first ink is jetted;

wherein the protrusions include:

a first protrusion, which is positioned between two connecting portion arrays arranged to be adjacent to each other and including the connecting portion array corresponding to the first nozzle array, and which is formed with the plurality of wires connected to the connecting portions corresponding to a plurality of first nozzles belonging to the first nozzle array; and a second protrusion, which is positioned between two connecting portion arrays arranged to be adjacent to each other and corresponding to the second nozzle arrays, and which is formed with the plurality of wires connected to the connecting portions corresponding to a plurality of second nozzles belonging to the second nozzle arrays;

wherein the number of the plurality of wires formed in the first protrusion is greater than the number of the plurality of wires formed in the second protrusion; and wherein a surface area of the first protrusion is greater than a surface area of the second protrusion.

8. The liquid jetting apparatus according to claim 7;

wherein the first protrusion projects, greater than the second protrusion, with respect to the connecting surface, of the flexible wiring member, for connecting with the actuator.

9. A method for producing the liquid jetting apparatus as defined in claim 1, comprising:

providing the channel unit as defined in claim 1;

providing the actuator as defined in claim 1;

providing the flexible wiring member as defined in claim 1; and joining the connecting portions to the connecting terminals respectively in a state that a portion of the flexible wiring member, which is different from a portion formed with the connecting portions and at which at least a part of the plurality of wires is formed, is bent in a mountain shape to project in a direction, which intersects and is away from a connecting surface, of the flexible wiring member, for connecting with the actuator.

10. The method for producing the liquid jetting apparatus according to claim 9;

wherein the nozzles form a plurality of nozzle arrays, each of which extends in a predetermined first direction parallel to a first connecting surface, of the actuator, for connecting with the flexible wiring member, and which are arranged in a second direction perpendicular to the first direction and parallel to the first connecting surface of the actuator;

wherein the connecting terminals form a plurality of connecting terminal arrays, each of which extends in the first direction and which are arranged in the second direction;

wherein the connecting portions form a plurality of connecting portion arrays, each of which extends in the first direction and which are arranged in the second direction;

wherein a distance, along a planar direction of the flexible wiring member, between the connecting portion arrays arranged to be adjacent to each other is greater than a distance, in the second direction, between the connecting terminal arrays arranged to be adjacent to each other; and wherein the connecting portions are joined to the connecting terminals in a state that a portion, of the flexible wiring member, positioned between the connecting portion arrays arranged to be adjacent to each other is bent so that a distance, in the second direction, between the connecting portion arrays arranged to be adjacent to each other is the same as the distance, in the second direction, between the connecting terminal arrays arranged to be adjacent to each other.

11. The method for producing the liquid jetting apparatus according to claim 9;

wherein the connecting portions are connected to the connecting terminals and a predetermined shape retaining member is joined to the actuator, in a state that a shape of the bent portion of the flexible wiring member is retained by the shape retaining member.

12. The liquid jetting apparatus according to claim 1;

wherein the channel unit has:

a first surface to which the plurality of nozzles are open; and a second surface which faces the first surface;

wherein the actuator is provided on the second surface of the channel unit; and wherein a second connecting surface, of the actuator, for connecting with the channel unit faces the second surface of the channel unit.

13. The liquid jetting apparatus according to claim 12;

wherein the protrusion is formed to project toward a direction, which is perpendicular to the first surface of the channel unit and opposite to a liquid-jetting direction form the plurality of nozzles.

14. The method for producing the liquid jetting apparatus according to claim 11;

wherein the shape retaining member is removed after joining the connecting portions to the connecting terminals respectively.

15. The liquid jetting apparatus according to claim 7;

wherein the first protrusion and the second protrusion have the same protrusion amount with respect to the connecting surface, of the flexible wiring member, for connecting with the actuator; and wherein a first width of the first protrusion in the second direction is greater than a second width of the second protrusion.

16. The liquid jetting apparatus according to claim 3;

wherein the shape retaining member is formed with a recess portion in which the protrusion is accommodated; and wherein the liquid jetting apparatus further comprises a support portion which is provided in the recess portion of the shape retaining member and which supports the protrusion accommodated in the recess portion of the shape retaining member.

17. The liquid jetting apparatus according to claim 3;

wherein the nozzles form a nozzle array extending in a predetermined first direction parallel to the first surface of the channel unit; and wherein the shape retaining member is provided as two separated shape retaining members disposed to face both end portions of the flexible wiring member in the first direction.

18. The liquid jetting apparatus according to claim 17;

wherein each of the two separated shape retaining member is formed with a recess portion in which the protrusion is accommodated; and wherein the protrusion is joined by an adhesive to the recess portion of each of the two separated shape retaining member.

* * * * *